US012808182B2

(12) United States Patent
Mohanraj et al.

(10) Patent No.: US 12,808,182 B2
(45) Date of Patent: Nov. 24, 2026

(54) BARRIER FILM FOR CONSTRUCTION

(71) Applicant: Berry Global, Inc., Evansville, IN (US)

(72) Inventors: Jagannathan Mohanraj, Sutton Coldfield (GB); Kenneth Gargan, Heswall Wirral (GB)

(73) Assignee: Berry Global, Inc., Evansville, IN (US)

( * ) Notice: Subject to any disclaimer, the term of this patent is extended or adjusted under 35 U.S.C. 154(b) by 184 days.

(21) Appl. No.: 18/428,635

(22) Filed: Jan. 31, 2024

(65) Prior Publication Data

US 2024/0263439 A1 Aug. 8, 2024

Related U.S. Application Data

(60) Provisional application No. 63/442,627, filed on Feb. 1, 2023.

(51) Int. Cl.
*E04B 1/66* (2006.01)

(52) U.S. Cl.
CPC ..... *E04B 1/665* (2013.01)

(58) Field of Classification Search
CPC ..... E04B 1/665; E02D 31/008; E02D 2300/0015; E02D 2300/0009
See application file for complete search history.

(56) References Cited

U.S. PATENT DOCUMENTS 5,496,615 A * 3/1996 Bartlett ..... E01D 19/083 428/354
10,724,231 B1 * 7/2020 Treville ..... E04B 1/76
2005/0118446 A1 * 6/2005 Faucher ..... B32B 11/10 428/537.1
2006/0051558 A1 * 3/2006 Sieber ..... B32B 5/18 428/131
2007/0224003 A1 * 9/2007 Janesky ..... E04B 1/665 405/270
2015/0376895 A1 * 12/2015 Fox ..... E04B 1/62 52/302.3
2022/0056660 A1 2/2022 Busatta
2022/0251798 A1 * 8/2022 Lolley ..... E04B 1/7069
2022/0348741 A1 11/2022 Dotson

FOREIGN PATENT DOCUMENTS

EP 2491079 B1 7/2016
EP 3049388 B1 8/2019

OTHER PUBLICATIONS

Milliken, "UltraGuard(TM) Solutions Natural 10309 Technical Data Sheet," Mar. 22, 2021, 1 page.
International (PCT) Search Report and Written Opinion for PCT/US24/13770 dated May 15, 2024, 8 pages.
Holmes, M. "Sustainability the key driver in film additive innovation", Compounding World, ISSN 2053-7174, Jan. 15, 2023, retrieved Apr. 22, 2024, retrieved from the internet: URL: https://www.milliken.com/-/media/files/chemical/resources/cw-jan-2023-film-additives.pdf?la=en-gb, 3 pages.

* cited by examiner

*Primary Examiner* — Beth A Aubrey
(74) *Attorney, Agent, or Firm* — Barnes & Thornburg LLP

(57) ABSTRACT

A ground gas and vapor barrier film for building and construction is made from a barrier film formulation comprising at least a polymeric resin and a barrier additive. The barrier film is made in an extrusion process.

20 Claims, 10 Drawing Sheets

BARRIER FILM FOR CONSTRUCTION

PRIORITY CLAIM

This application claims priority under 35 U.S.C. § 119(e) to U.S. Provisional Application Ser. No. 63/442,627, filed Feb. 1, 2023, which is expressly incorporated by reference herein.

BACKGROUND

The present disclosure relates to barrier films, and particularly to ground gas and vapor barrier films. More particularly, the present disclosure relates to ground gas and vapor barrier films for structures.

SUMMARY

According to the present disclosure, a film is used to form a barrier film for a structure, for example in building and construction foundations. The film of the present disclosure may be a monolayer film or a multilayer film.

In one illustrative embodiment, the present disclosure provides a barrier film including a polymeric sheet adapted to lie between ground underlying a structure and a portion of the structure to minimize movement of a gas from the ground through the polymeric sheet and into the structure. The polymeric sheet may be formed from a monolayer film or a multilayer film configured to provide a tortuous path for the gas from the ground, thereby minimizing movement of the gas through the polymeric sheet.

In another illustrative embodiment, the present disclosure provides a barrier film including a polymeric sheet adapted to lie between ground underlying a foundation of a building and the foundation of the building to minimize movement of a gas from the ground through the polymeric sheet and into the building. The polymeric sheet may be formed from a monolayer film or a multilayer film configured to provide a tortuous path for the gas from the ground, thereby minimizing movement of the gas through the polymeric sheet.

In one illustrative embodiment, the present disclosure provides a barrier film including at least one layer comprising a formulation. The formulation of the barrier film includes a polymeric resin, and an additive. The formulation is prepared to provide a tortuous path for ground gas and vapor contact through the barrier film so that ground gas and vapor permeation is minimized.

In one illustrative embodiment, the present disclosure provides a method of providing a barrier film to a structure. The method includes positioning the barrier film to lie between ground underlying the structure and a portion of the structure to minimize movement of a gas from the ground through the polymeric sheet and into the structure.

In another illustrative embodiment, the present disclosure provides a method of providing a barrier film to a foundation. The method includes positioning the barrier film to lie between ground underlying a foundation of a building and the foundation to minimize movement of a gas from the ground through the polymeric sheet and into the building.

In one illustrative embodiment, the present disclosure provides a barrier film comprising a barrier additive. For example, the barrier film may comprise a barrier additive, such as a nucleating additive, a functional additive, or combination of a nucleating additive and a functional additive.

In illustrative embodiments, a film-manufacturing process provides a barrier film. Barrier films as disclosed herein may be made by any suitable extrusion or co-extrusion process, such as a blown film extrusion process or a cast film extrusion process.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

Figure 5:
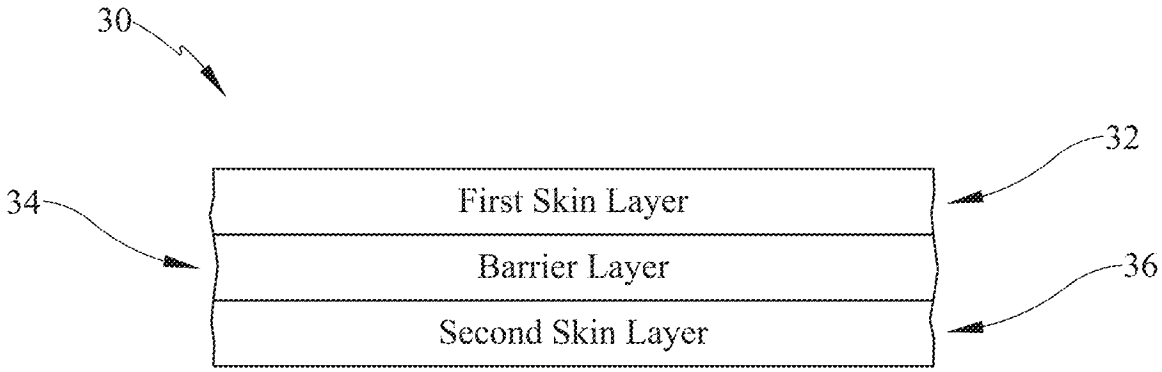
Figure 6:
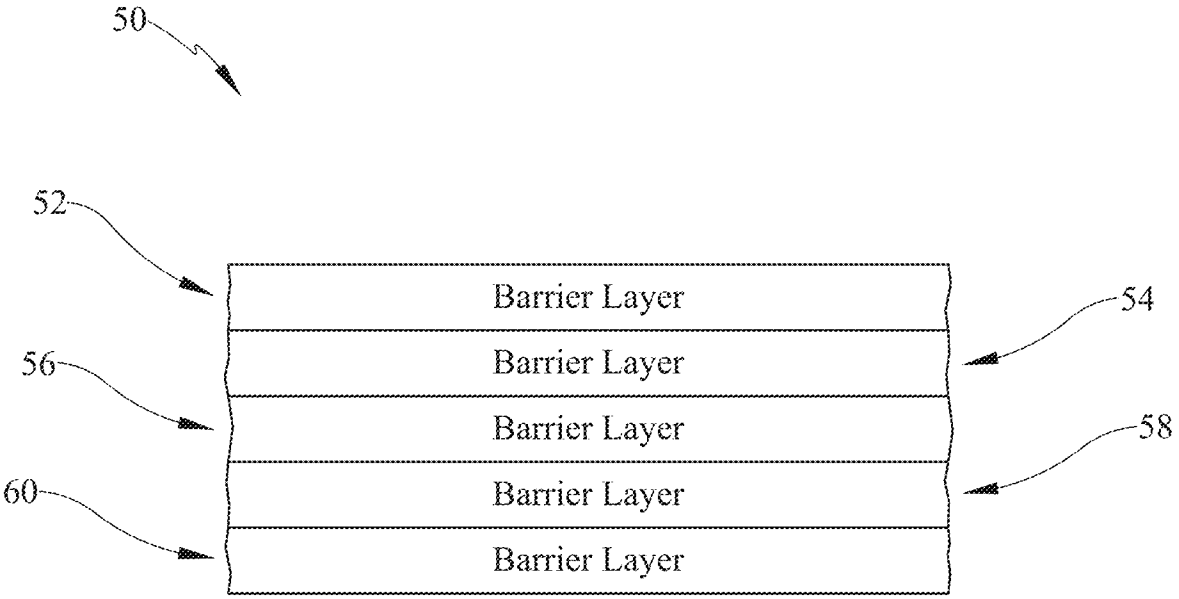
Figure 7:
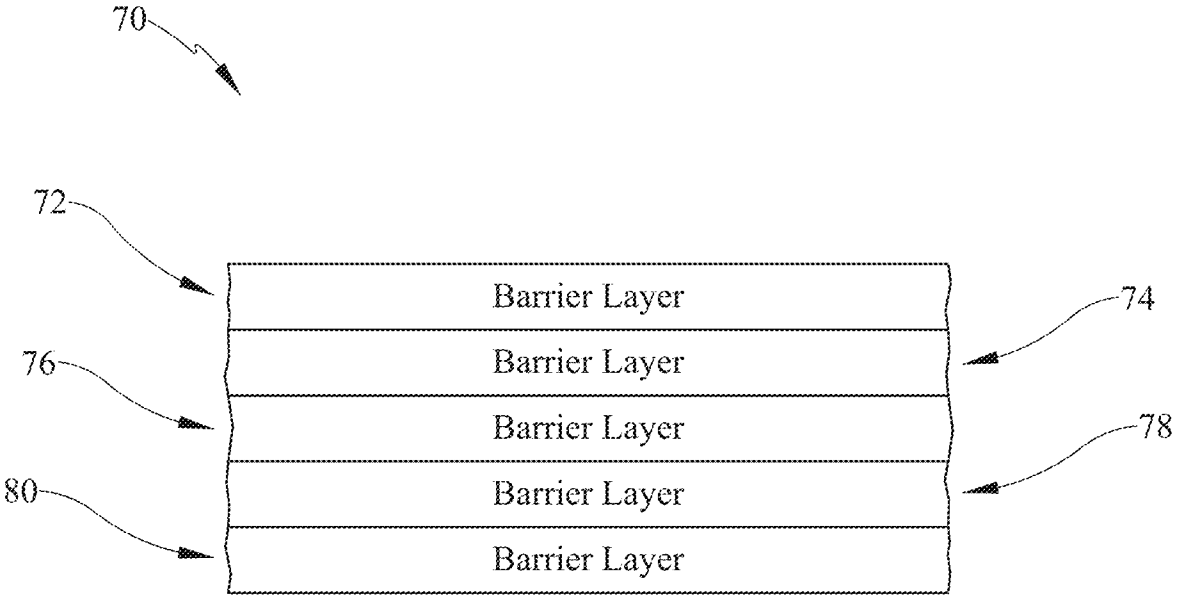
Figure 8:
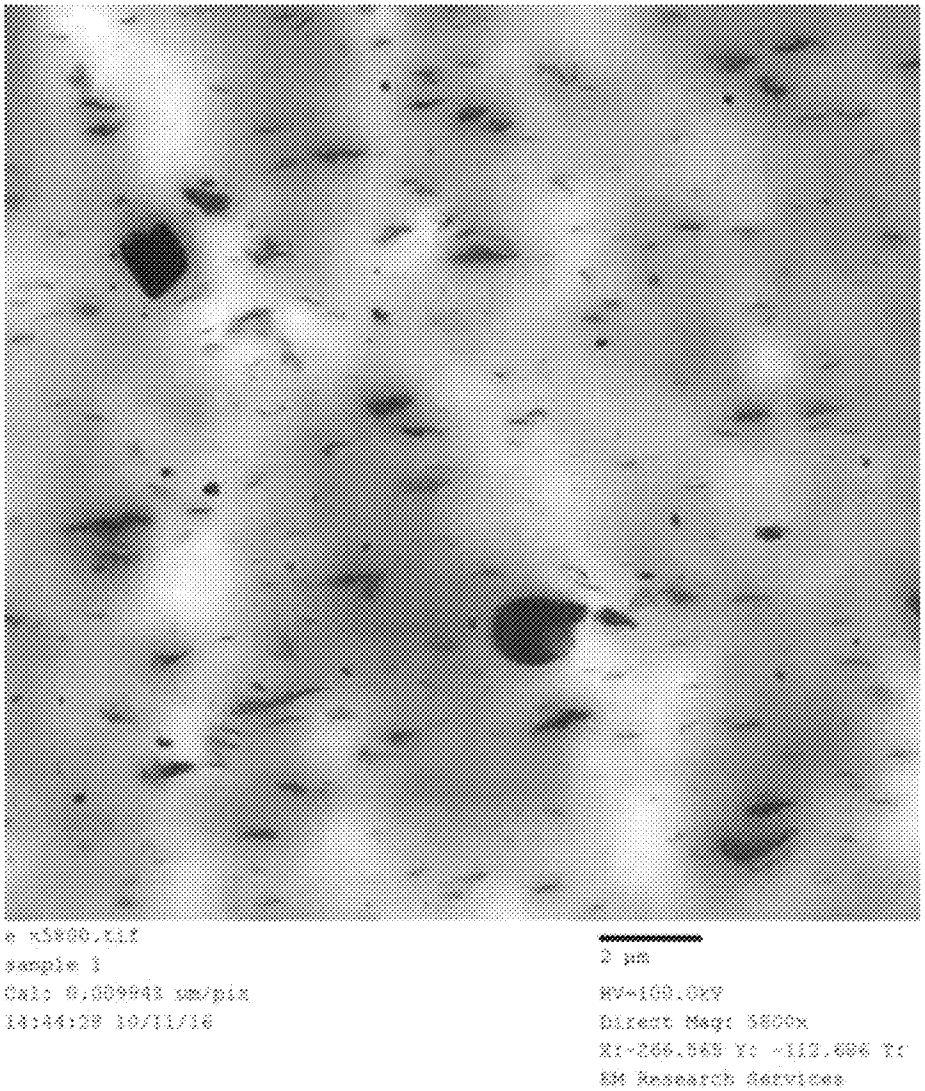
Figure 9:
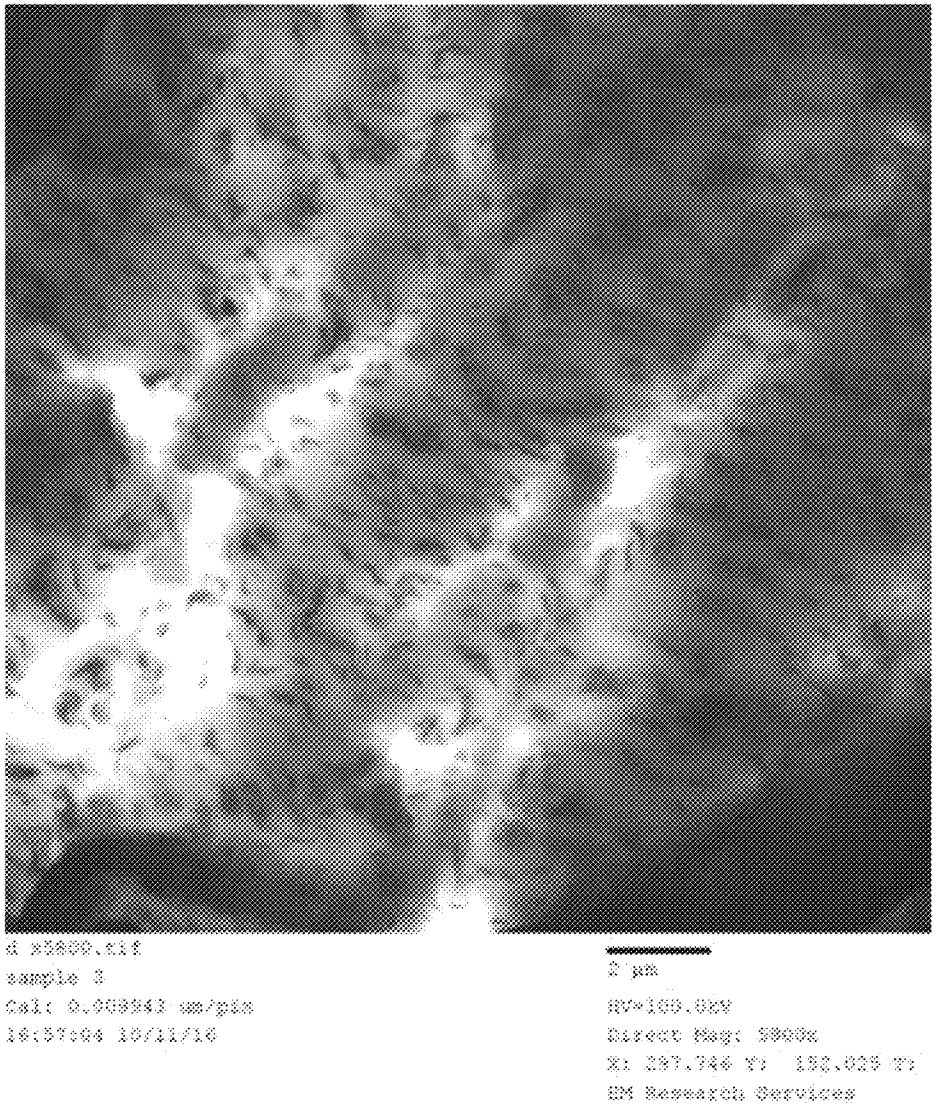

FIG. 5 is diagrammatic view of the barrier film in accordance with the present disclosure showing that the barrier film 30 may be a multilayer film including an optional first skin layer 32, barrier layer 34, and optional second skin layer 36;

FIG. 6 is diagrammatic view of the barrier film in accordance with the present disclosure showing that the barrier film 50 may be a film including five layers of the same formulation including a first barrier layer 52, a second barrier layer 54, a third barrier layer 56, a fourth barrier layer 58, and a fifth barrier layer 60;

FIG. 7 is diagrammatic view of the barrier film in accordance with the present disclosure showing that the barrier film 70 may be a multilayer film including a first barrier layer 72, a second barrier layer 74, a third barrier layer 76, a fourth barrier layer 78, a and a fifth barrier layer 80;

FIG. 8 is a TEM image of a barrier film in accordance with the present disclosure, the barrier film including 20 wt % of a barrier additive; and FIG. 9 is a TEM image of a barrier film in accordance with the present disclosure, the barrier film including 10 wt % of a barrier additive.

DETAILED DESCRIPTION

Figure 1A:
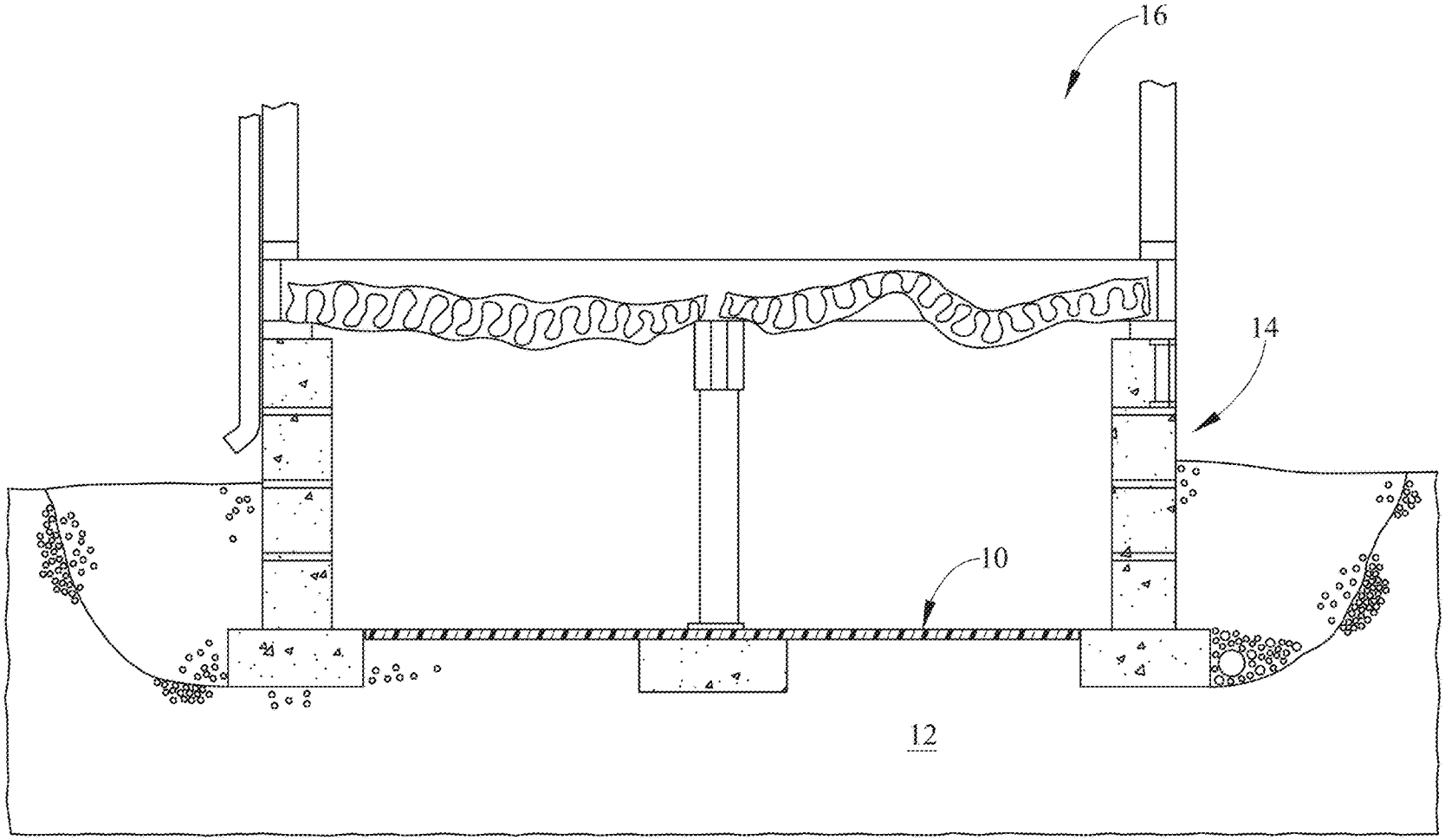
FIG. 1A is an elevation view of a portion of a building showing a barrier film located between ground underlying the building and a space formed by the building.
Figure 1B:
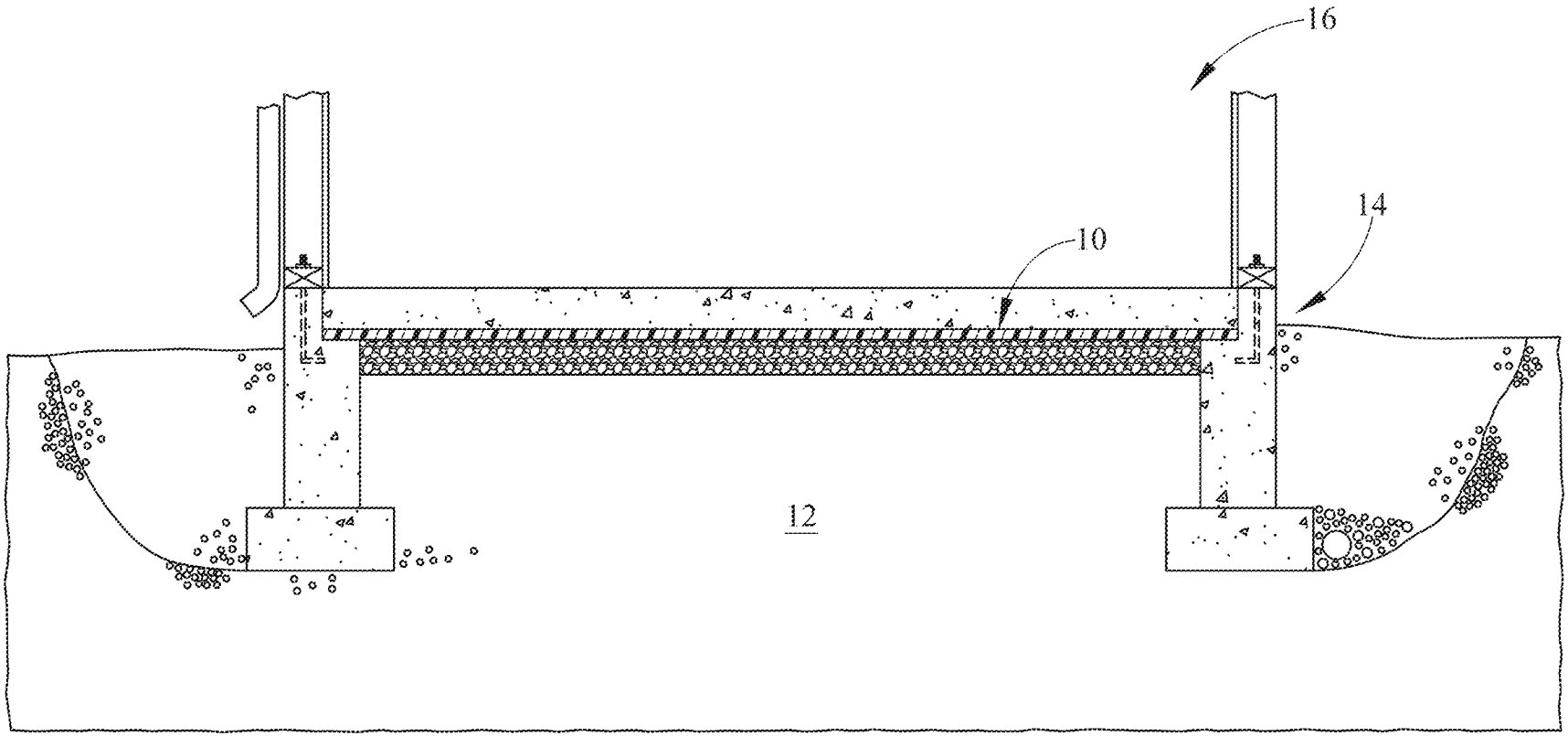
FIG. 1B is an elevation view of a portion of a building showing a barrier film located between ground underlying the building a slab of concrete poured on top of the barrier film.

In one illustrative embodiment, the present disclosure provides a barrier film as shown in FIGS. 1A and 1B. is an elevation view of a portion of a building. In one example, the barrier film according to the present disclosure may be located between ground underlying the building and a space formed by the building, for example, a crawl space as shown in FIG. 1A. In another example, the barrier film according to the present disclosure may be located between ground underlying the building a slab of concrete poured on top of the barrier film as shown in FIG. 1B. In another example, the barrier film may be located between a portion of a structure, such as brick and block work in a hollow wall construction in the perimeter of a building. For example, the barrier film may be located in a gas resistant damp proof course or gas resistant cavity tray.

In one illustrative embodiment, the barrier film 10 is formed from a polymeric sheet adapted to lie between ground 12 underlying a foundation 14 of a building 16 and the foundation 14 to block gases from moving from the ground 12 through the polymeric sheet and into the building 16, as shown in FIGS. 1A and 1B. The barrier film is configured to provide a tortuous path for gases from the ground 12 so that the movement of the gases through the film is minimized.

Films as disclosed herein may be made by many suitable methods, including, but not limited to, blown film extrusion, cast film extrusion processes, or any other suitable processes. Films as disclosed herein may be made by any suitable extrusion process, such as a blown film extrusion process 100 or a cast film extrusion process 200.

Figure 2:
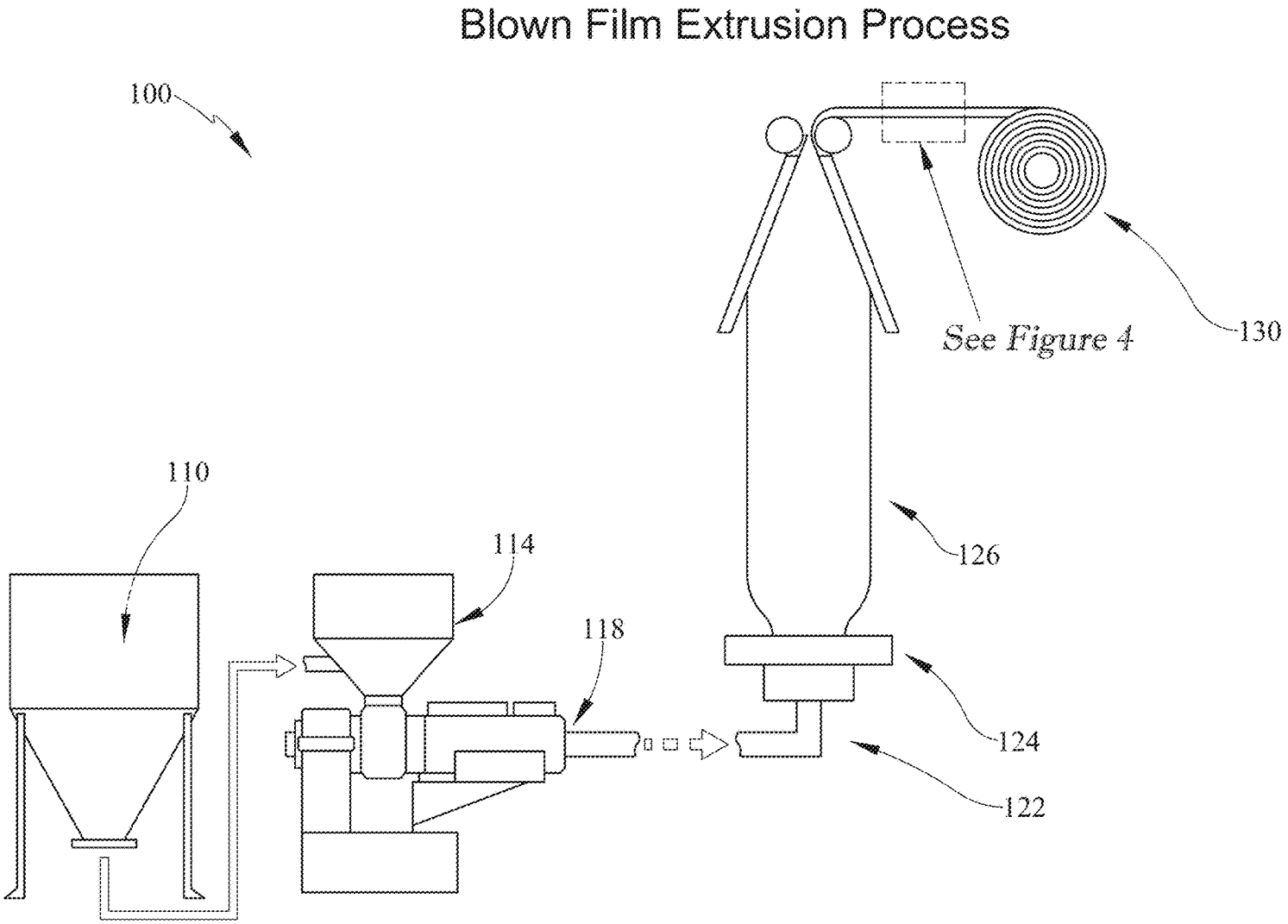
FIG. 2 is a diagrammatic view of a process for making a barrier film in accordance with the present disclosure showing that barrier film may be made in a blown film extrusion process.

In one illustrative embodiment, the barrier film is formed in the blown film manufacturing process 100, as shown illustratively in FIG. 2. The barrier film, in one example, is a mono-extruded film or a co-extruded film in which each extruded layer comprises a composition. Illustratively, the composition is formed by processing a formulation. Illustratively, each formulation of each layer be added to a hopper 110, blended and heated in an extruder 114 to produce a molten material 118. Illustratively, molten materials pass through a die 122 to form a molten extrudate. Molten materials can pass through an annular, or tubular, die to form a molten extrudate 124, for example a molten tubular film, and subjected to a blowing operation, thereby forming a blown film 126. The blown film 126 may be subjected to optional orienting operations or pass over optional equipment such as idler rolls, chills rolls, stretching rolls before transferring the film to winder 130 where it is wound and stored to await further processing.

Figure 3:
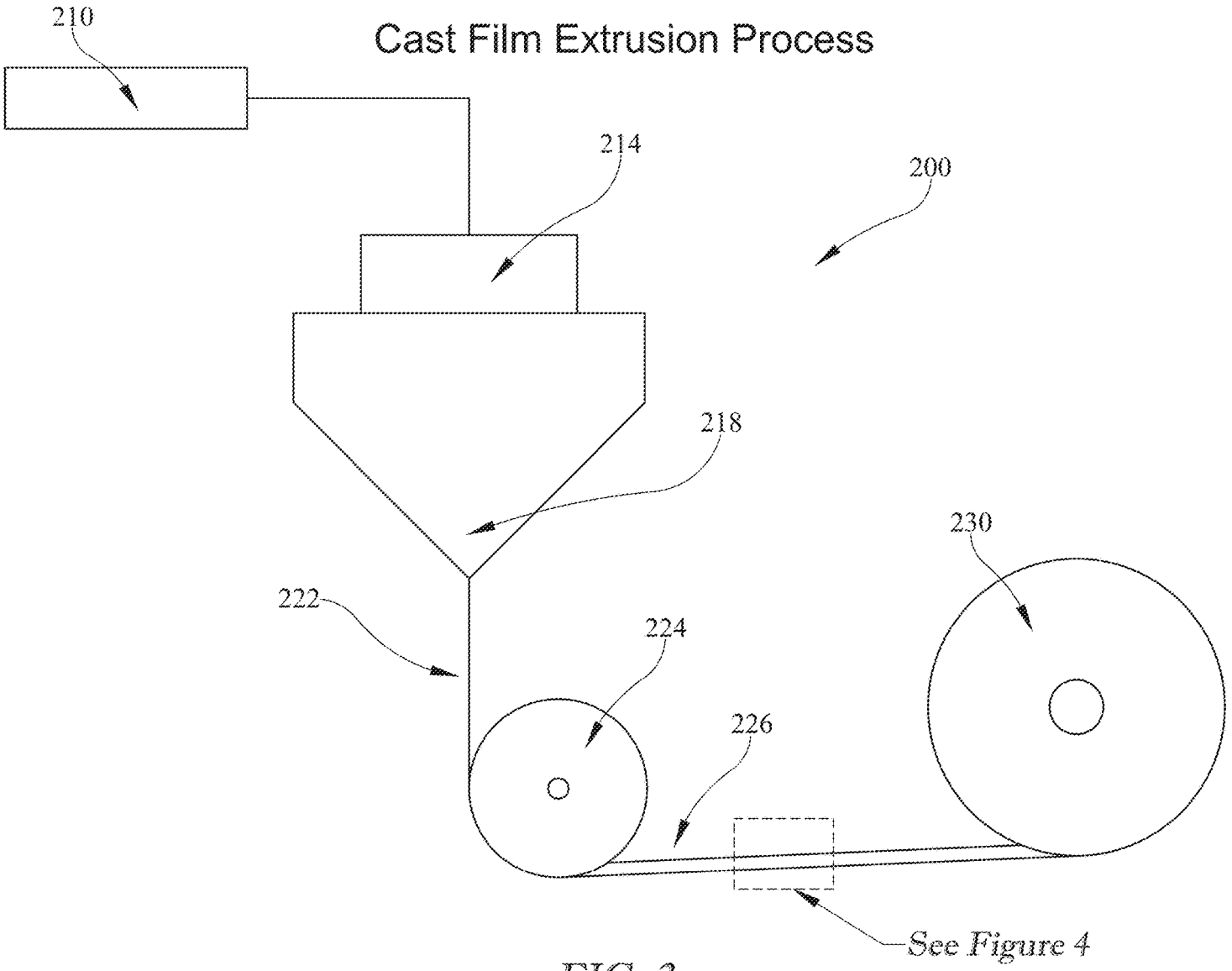
FIG. 3 is a diagrammatic view of a process for making a barrier film in accordance with the present disclosure showing that barrier film may be made in a cast film extrusion process.

In another illustrative embodiment, the barrier film is formed in a cast film manufacturing process 200, as shown illustratively in FIG. 3. Illustratively, each formulation of each layer be added to a hopper 210, blended and heated in an extruder 214 to produce a molten material. Illustratively, molten materials pass through a die 218 to form a molten extrudate 222. Molten materials can pass through a flat, or linear, die, to form a molten extrudate 222 passed onto a cast roll 224 where the molten extrudate is cooled to form the cast film 226. The cast film may be subjected to optional orienting operations or pass over optional equipment such as idler rolls, chills rolls, stretching rolls before transferring the film to winder 230 where it is wound and stored to await further processing.

In one example, the barrier film according to the present disclosure may limit the permeation of gases. In another example, the barrier film according to the present disclosure may limit the permeation of gases such as methane, radon, carbon dioxide, oxygen, water vapor, carbon monoxide, or any other suitable gas. In another example, the barrier film according to the present disclosure may limit the permeation of gases such as ground gases including, but not limited to, radon, carbon dioxide, and methane. In another example, the barrier film according to the present disclosure may limit the permeation of gases by minimizing the movement of gases from the ground through the polymeric sheet and into the building. In another example, the barrier film according to the present disclosure provides a passive system to limit the permeation of gases to minimize gases from moving from the ground through the polymeric sheet and into the building.

In one example, the permeation of gas through the barrier film according to the present disclosure is measured by a gas transmission rate test. As used herein, "gas transmission rate" refers to the volume of gas passing through a material, per unit area and unit time, under unit partial-pressure difference between the two sides of the material. As used herein, the "gas permeation" refers to volume of gas passing through a material of unit thickness, per unit area and unit time, under unit partial-pressure difference between the two sides of the material.

In one example, barrier films are prepared to meet standards for gas permeability and transmission rates. In another example, barrier films are prepared to exceed standards for gas permeability and transmission rates. The standards for which the films are prepared to meet include, but are not limited to, ASTM standard D1434, ASTM standard D3985, ASTM F2714-08, and BS ISO 15105 part 1 and 2 (BS ISO 15105-1 and 15105-2), each of which is incorporated by reference herein in their entirety. In one example, barrier films described herein provide an average methane gas transmission rate of less than 40 mL/day/$m^2$/atm.

Figure 4:
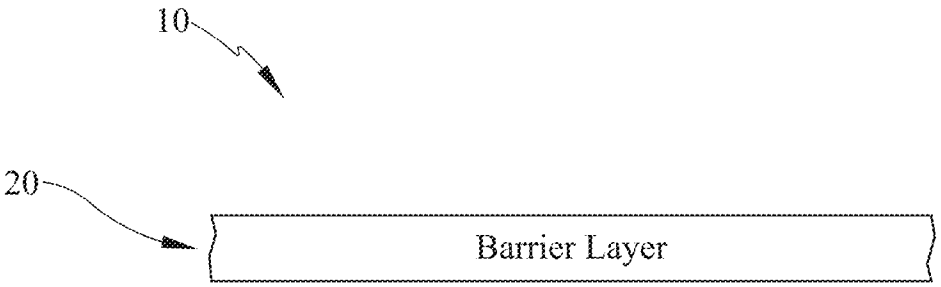
FIG. 4 is diagrammatic view of the barrier film in accordance with the present disclosure showing that the barrier film 10 is a monolayer film.

In one illustrative embodiment, the barrier film 10 is a mono-extruded monolayer film as shown in FIG. 4. The barrier film 10, in one example, is a mono-extruded film in which the extruded monolayer comprises a composition. In one example, the monolayer is a barrier layer 20.

In another illustrative embodiment, the barrier film 30 is a co-extruded multilayer film as shown in FIG. 5. The barrier film 30, in one example, is a co-extruded film in which each layer comprises a composition. In some embodiments, barrier film 30 includes an optional first skin layer 32, barrier layer 34, and an optional second skin layer 36.

In another illustrative embodiment, the barrier film 50 is a co-extruded monolayer film as shown in FIG. 6. The barrier film 50, in one example, is a co-extruded film in which each layer comprises the same composition. For example, first barrier layer 52, second barrier layer 54, third barrier layer 56, fourth barrier layer 58, and fifth barrier layer 60 comprise the same composition. In one example, each layer of barrier film 50 is a barrier layer. In some examples, a co-extruded film in which each layer comprises the same composition, for example barrier film 50, can be referred to as a co-extruded monolayer film.

In another illustrative embodiment, the barrier film 70 is a co-extruded multilayer film as shown in FIG. 7. The barrier film 70, in one example, is a co-extruded film in which each layer comprises a composition. For example, each layer of barrier film 70 is a barrier layer. In one example, first barrier layer 72, second barrier layer 74, third barrier layer 76, fourth barrier layer 78, and fifth barrier layer 80 each include a composition.

In certain embodiments, each layer of the barrier film may comprise a composition. Each layer of the barrier film may comprise, for example, a polymeric resin or material and may optionally include one or more additives. In one example, the barrier film comprises a polymeric resin, including but not limited to, a polyethylene polymer, a polypropylene polymer, a polystyrene polymer. In one example, the polymeric resin is a polyethylene polymer. The polyethylene polymer may be any suitable polyethylene polymer. In another example, the polyethylene polymer may be low density polyethylene (LDPE), linear low density polyethylene (LLDPE), medium density polyethylene (MDPE), high density polyethylene (HDPE), or suitable combinations thereof. In another example, the polyethylene polymer may be a metallocene polyethylene (mPE). In another example, the formulation of the barrier film may comprise BORSTAR® FB2230 resin available from Borealis, LUMICENE® mPE M6012 EP resin available from Total Energies, and SABIC® LDPE 2100N0W resin available from SABIC Europe.

In another example, the barrier film further comprises one or more additives. Suitable additives include, but are not limited to, barrier additives, UV inhibitor additives, antioxidant additives, antiblocking additives, pigment additives, colorant additives, filler additives, clarifying additives, acid scavenger additives, polymer processing additives (PPAs), and slip additives. In one example, the additive comprises a colorant additive. In one example, the barrier film may comprise a color masterbatch, for example, Yellow ML73480 available from Silvergate Pharmaceuticals.

In some embodiments, the additive is a barrier additive. In some embodiments, the barrier additive is a physical barrier additive, a nucleating additive (agent), or a functional additive.

In some embodiments, the barrier additive is a physical barrier additive. For example, the physical barrier additive includes, but is not limited to, graphene, micro talc, micaceous iron oxide, mica, nano barrier particles, and the like. Physical barrier additives, such as glass spheres, can be optionally added to the barrier additive to promote exfoliation.

In some embodiments, it may be advantageous to limit the mean particle size of physical barrier additives to improve barrier properties and/or promote exfoliation. For example, the mean particle size of physical barrier additive may be one of several different percentages or fall within one of several different ranges. The mean particle size of physical barrier additive, such as micro talc, may be about 3 μm, about 3.1 μm, about 3.2 μm, about 3.3 μm, about 3.4 μm, about 3.5 μm, and about 3.6 μm. It is within the present disclosure for the mean particle size of physical barrier additive, such as micro talc, to fall within one of the following ranges: less than about 5 μm, less than about 4 μm, about 0.5 μm to about 5 μm, about 0.5 μm to about 4 μm, about 1 μm to about 5 μm, about 1 μm to about 4 μm, about 2 μm to about 5 μm, and about 2 μm to about 4 μm.

In some embodiments, the barrier additive is a nucleating agent. In one example, the barrier film may comprise ULTRAGUARD™ Solutions Natural 10309 masterbatch resin available from Milliken & Co. In another example, the nucleating agent comprises a compound of the formula I (I)

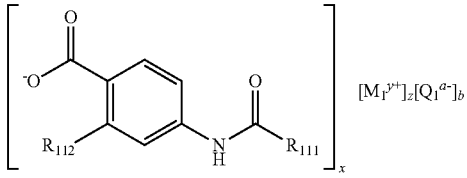

wherein $R_{111}$ is cyclopentyl or a group

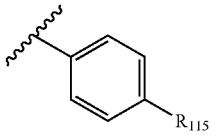

wherein $R_{115}$ is H, halogen, methoxy or phenyl;

$R_{112}$ is H or OH x is a positive integer;

$M_1$ each is a metal cation;

y is the valence of $M_1$;

z is a positive integer;

b is zero or a positive integer; when b is a positive integer, $Q_1$ each is a negatively-charged counterion and a is the valence of $Q_1$;

wherein x, y, z, a, and b satisfy the equation x+(ab)=yz; and if $R_{115}$ is H, then $R_{112}$ is H, x=1, $M_1$ is a lithium cation, y=1, z=1, and b=0; and if $R_{115}$ is methoxy, then $R_{112}$ is OH.

In another example, the nucleating agent comprises a compound selected from the group consisting of

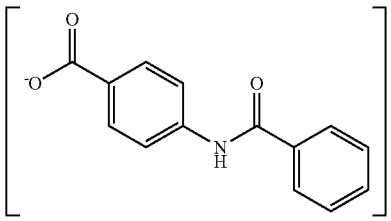

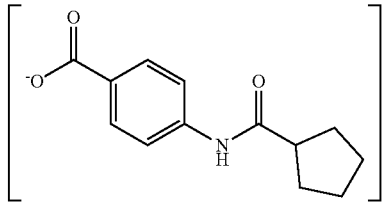

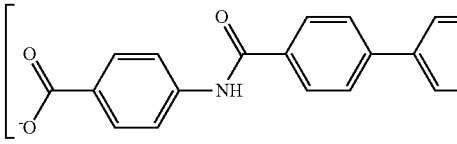

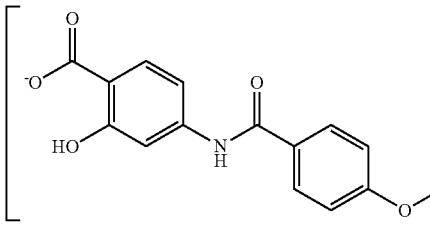

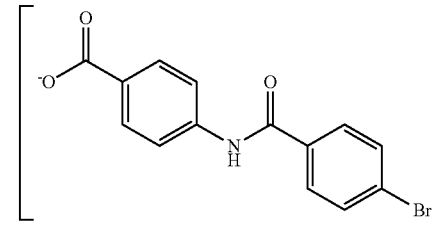

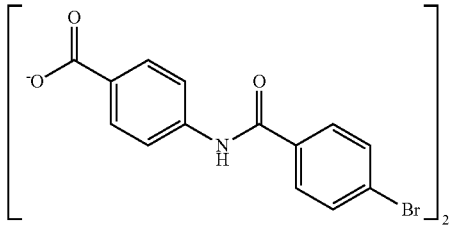

-continued

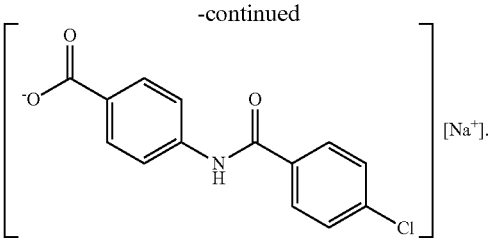

In another example, the nucleating agent comprises a compound of the formula II, III, or IV, (II)

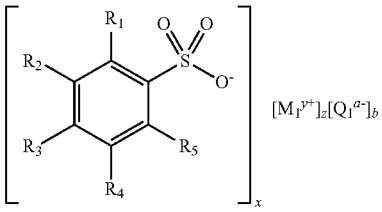

(III)

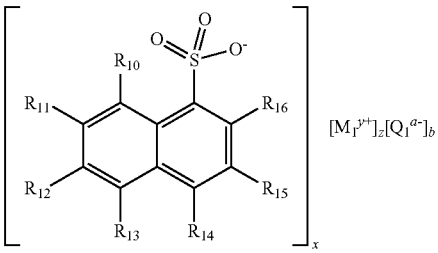

(IV)

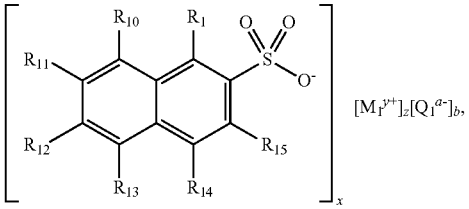

wherein x is a positive integer;

$R_1$-$R_5$ and $R_{10}$-$R_{16}$ each independently are H, OH, $C_{1-9}$-alkyl, $C_{1-9}$-alkenyl, $C_{1-9}$-alkynyl, $C_{1-9}$-alkoxy $C_{1-9}$-hydroxyalkyl, an alkyl ether group, amino, $C_{1-9}$-alkylamino, halogen, aryl, alkylaryl, or a geminal or vicinal $C_{\leq 9}$-carbocycle;

$M_1$ each is a cation which is selected from transition metal cations and group 13 metal cations; and y is the valence thereof, z is a positive integer;

$Q_1$ each is a negatively-charged counterion, and a is the valence thereof; and b is 0 or a positive integer;

and the values of x, y, z, a, and b satisfy the equation x+(ab)=yz.

In another example, the nucleating agent comprises a compound of the formula II, III, or IV, wherein $R_1$-$R_5$ and $R_{10}$-$R_{16}$ are each H. In another example, the nucleating agent comprises a compound of the formula II, III, or IV, wherein $M_1$ is a Zn cation.

Polyethylene polymers contain crystalline regions interspersed with amorphous regions. The term "lamellae" or "lamellar" as used herein refers to ordered configurations of folded polyethylene. The crystalline regions are the result of the direction and geometry of lamellar growth. Without being bound by any theory, the speed of cooling and extensional strain can alter the configurations of polyethylene chains. Slow cooling could promote lamellar growth, while fast cooling could promote the polyethylene chains to remain disordered. Low extensional strain could promote lamellar growth radially, which may result in spherical aggregates, spherulites. Extensional strain, for instance, flow direction strain or machine direction strain, could promote lamellar growth in an orthorhombic orientation. Without being bound by any theory, the quantity, uniformity, and orientations of polyethylene crystalline regions can impact the physical properties of the polymer, including but not limited to barrier properties, stiffness, and tear strength.

As used herein, the term "nucleating agent" or "nucleating additive" refers to a compound or additive that forms a nuclei or provides a site for the formation or growth of crystals as it solidifies from a molten state. Without being bound by any theory, the nucleating agent can alter the configurations of polyethylene chains, lamellar growth, and crystalline pattern. In one example, a nucleating agent may alter characteristics of the crystallization of polyethylene, therefore altering physical properties of the polymer. Physical properties of the polymer include, but are not limited to, barrier properties, stiffness, and tear strength. In one example, a nucleating agent can alter or limit the size of the crystalline regions of polyethylene. In another example, a nucleating agent could improve uniformity or dispersion of the crystalline regions of polyethylene. In another example, a nucleating agent can alter the direction of lamellar growth of the crystalline regions of polyethylene.

In some embodiments, the barrier additive is a functional additive. Functional additives, for example, may enhance barrier properties. In some embodiments, the functional additive is a hydrocarbon additive. In some embodiments, the hydrocarbon additive includes, but is not limited to, aliphatic resins, aromatic resins, mixed aliphatic and aromatic resins, aromatic-modified aliphatic resins, terpene resins, modified-terpene resins, and the like. In one example, the barrier film may comprise GASTOP-FLEX™ 1001293-E available from Ampacet, or QOLORTECH® IQfilms available from Qolortech.

In one example, the barrier film comprises HDPE, LLDPE, and LDPE. In another example, the barrier film comprises HDPE, LLDPE, LDPE, and an additive. In another example, the barrier film comprises HDPE, LLDPE, LDPE, and a barrier additive. In another example, the barrier film comprises HDPE, LLDPE, LDPE, and a polymer processing additive. In another example, the barrier film comprises HDPE, LLDPE, LDPE, and an antioxidant additive. In another example, the barrier film comprises HDPE, LLDPE, LDPE, and a colorant additive. In another example, the barrier film comprises HDPE, LLDPE, LDPE, a barrier additive and a polymer processing additive. In another example, the barrier film comprises HDPE, LLDPE, LDPE, a barrier additive and an antioxidant additive. In another example, the barrier film comprises HDPE, LLDPE, LDPE, a barrier additive, and a colorant. In another example, the barrier film comprises HDPE, LLDPE, LDPE, a barrier additive, a polymer processing additive, and an antioxidant additive. In another example, the barrier film comprises HDPE, LLDPE, LDPE, a barrier additive, a polymer processing additive, an antioxidant additive, and a colorant.

In some embodiments, each barrier layer of the barrier film comprises, for example, a polyolefin polymer. Each barrier layer of barrier film may comprise, for example, a polymeric resin or material and may optionally include one or more additives. In one example, the barrier layer comprises a polymeric resin, including but not limited to, a polyethylene polymer, a polypropylene polymer, a polystyrene polymer. In one example, the barrier layer of barrier film comprises a polyethylene polymer. The barrier layer of barrier film comprises any suitable polyethylene polymer. In another example, the barrier layer of barrier film comprises low density polyethylene (LDPE), linear low density polyethylene (LLDPE), medium density polyethylene (MDPE), high density polyethylene (HDPE), or combinations thereof. In another example, the barrier layer of barrier film comprises a metallocene polyethylene (mPE). In another example, the barrier layer of barrier film comprises BORSTAR® FB2230 resin available from Borealis, LUMICENE® mPE M6012 EP resin available from Total Energies, and SABIC® LDPE 2100N0W resin available from SABIC Europe.

In one example, each barrier layer of the barrier film comprises HDPE, LLDPE, and LDPE. In another example, each barrier layer of the barrier film comprises HDPE, LLDPE, LDPE, and an additive. In another example, each barrier layer of the barrier film comprises HDPE, LLDPE, LDPE, and a barrier additive. In another example, each barrier layer of the barrier film comprises HDPE, LLDPE, LDPE, and a polymer processing additive. In another example, each barrier layer of the barrier film comprises HDPE, LLDPE, LDPE, and an antioxidant additive. In another example, each barrier layer of the barrier film comprises HDPE, LLDPE, LDPE, and a colorant additive. In another example, each barrier layer of the barrier film comprises HDPE, LLDPE, LDPE, a barrier additive and a polymer processing additive. In another example, each barrier layer of the barrier film comprises HDPE, LLDPE, LDPE, a barrier additive and an antioxidant additive. In another example, each barrier layer of the barrier film comprises HDPE, LLDPE, LDPE, a barrier additive, and a colorant. In another example, each barrier layer of the barrier film comprises HDPE, LLDPE, LDPE, a barrier additive, a polymer processing additive, and an antioxidant additive. In another example, each barrier layer of the barrier film comprises HDPE, LLDPE, LDPE, a barrier additive, a polymer processing additive, an antioxidant additive, and a colorant.

In another example, a barrier layer of the barrier film comprises one of HDPE, LLDPE, or LDPE. In another example, each barrier layer of the barrier film comprises one of HDPE, LLDPE, or LDPE, and an additive. In another example, each barrier layer of the barrier film comprises one of HDPE, LLDPE, or LDPE, and a barrier additive. In another example, each barrier layer of the barrier film comprises one of HDPE, LLDPE, or LDPE, and a polymer processing additive. In another example, each barrier layer of the barrier film comprises one of HDPE, LLDPE, or LDPE, and an antioxidant additive. In another example, each barrier layer of the barrier film comprises one of HDPE, LLDPE, or LDPE, and a colorant additive. In another example, each barrier layer of the barrier film comprises one of HDPE, LLDPE, or LDPE, a barrier additive and a polymer processing additive. In another example, each barrier layer of the barrier film comprises one of HDPE, LLDPE, or LDPE, a barrier additive and an antioxidant additive. In another example, each barrier layer of the barrier film comprises one of HDPE, LLDPE, or LDPE, a barrier additive, and a colorant. In another example, each barrier layer of the barrier film comprises one of HDPE, LLDPE, or LDPE, a barrier additive, a polymer processing additive, and an antioxidant additive. In another example, each barrier layer of the barrier film comprises one of HDPE, LLDPE, or LDPE, a barrier additive, a polymer processing additive, an antioxidant additive, and a colorant.

In some embodiments, a barrier layer of the barrier film comprises LDPE and a functional additive. In some embodiments, a barrier layer of the barrier film comprises LLDPE, HDPE, and a nucleating additive.

In some embodiments, the barrier film comprises an optional first skin layer and an optional second skin layer. The skin layer is arranged to form an outer surface of the barrier film. In some embodiments, the skin layer may be free of one or more barrier additives. In one example, the skin layer does not include a barrier additive. In some embodiments, the barrier film comprises a first skin layer and a second skin layer. In another embodiment, the barrier film comprises a first skin layer and does not include a second skin layer. In another embodiment, the barrier film does not include a first skin layer and does not include a second skin layer.

In some embodiments, each skin layer of the barrier film comprises, for example, a polyolefin polymer. In one example, the skin layer of barrier film comprises a polyethylene polymer. The skin layer of barrier film comprises any suitable polyethylene polymer. In another example, the skin layer of barrier film comprises low density polyethylene (LDPE), linear low density polyethylene (LLDPE), medium density polyethylene (MDPE), high density polyethylene (HDPE), or combinations thereof. In another example, the skin layer of barrier film comprises a metallocene polyethylene (mPE).

In some embodiments, each barrier layer of the barrier film comprises, for example, a polyolefin polymer. Each barrier layer of barrier film may comprise, for example, a polymeric resin or material and may optionally include one or more additives. In one example, the barrier layer comprises a polymeric resin, including but not limited to, a polyethylene polymer, a polypropylene polymer, a polystyrene polymer. In one example, the barrier layer of barrier film comprises a polyethylene polymer. The barrier layer of barrier film comprises any suitable polyethylene polymer. In another example, the barrier layer of barrier film comprises low density polyethylene (LDPE), linear low density polyethylene (LLDPE), medium density polyethylene (MDPE), high density polyethylene (HDPE), or combinations thereof. In another example, the barrier layer of barrier film comprises a metallocene polyethylene (mPE). In another example, the barrier layer of barrier film comprises BORSTAR® FB2230 resin available from Borealis, LUMICENE® mPE M6012 EP resin available from Total Energies, and SABIC® LDPE 2100N0W resin available from SABIC Europe.

In some illustrative embodiments, barrier film may be free of one or more polymeric resins or materials to promote recyclability. In some illustrative embodiments, barrier film does not comprise or is free of EVOH, polypropylene, polyamide, polystyrene, or polyester to promote recyclability. In some illustrative embodiments, barrier film does not comprise polypropylene. In some illustrative embodiments, barrier film does not comprise polypropylene or polyester. In some illustrative embodiments, barrier film does not comprise polyamide or EVOH. In some illustrative embodiments, barrier film consists essentially of polyethylene. In some embodiments, barrier film consists essentially of polyethylene polymer or copolymer.

In some illustrative embodiments, it may be advantageous to limit the percentage of plastic polymers, resins, or materials to promote recyclability and minimize cost. In some illustrative embodiments, the barrier film according to the present disclosure may comprise a weight percentage or percent thickness of a particular plastic polymer, resin, or material, such as ethylene-vinyl alcohol copolymer (EVOH) or polyamide to promote recyclability and minimize cost. In some embodiments, barrier film does not comprise or is free of EVOH. In some embodiments, barrier film comprises a volume percent of less than about 5% EVOH. In another embodiment, barrier film does not comprise or is free of polyamide. In another embodiment, barrier film comprises a volume percent of less than about 5% polyamide.

In one example, the polyethylene polymer comprises a weight percent of about 95% of the barrier film. The polyethylene polymer weight percent of the barrier film may be one of several different percentages or fall within one of several different ranges. The weight percent of the polyethylene polymer of the barrier film may be one of the following values: about 85%, about 86%, about 87%, about 88%, about 89%, about 90%, about 91%, about 92%, about 93%, about 94%, about 95%, about 96%, about 97%, about 98%, about 99%, and about 100%. It is within the present disclosure for the polyethylene polymer weight percent of the barrier film to fall within one of the following ranges: greater than about 85%, about 85% to about 100%, about 85% to about 98%, about 90% to about 98%, about 85% to about 96%, about 90% to about 96%, about 92% to about 96%, and about 94% to about 96%. In one example, the remaining weight percentage comprises an additive. In another example, the remaining weight percentage comprises a barrier additive. In another example, the remaining weight percentage comprises a barrier additive and an antioxidant additive. In another example, the remaining weight percentage comprises a barrier additive and a polymer processing additive. In another example, the remaining weight percentage comprises a barrier additive, a polymer processing additive, and an antioxidant additive. In another example, the remaining weight percentage comprises a barrier additive and a colorant. In another example, the remaining weight percentage comprises a barrier additive, a polymer processing additive, and a colorant. In another example, the remaining weight percentage comprises a barrier additive, an antioxidant additive, and a colorant. In another example, the remaining weight percentage comprises a barrier additive, a polymer processing additive, an antioxidant additive, and a colorant.

In one example, the linear low density polypropylene (LLDPE) comprises a weight percent of about 40% of the barrier film. The LLDPE weight percent of the barrier film may be one of several different percentages or fall within one of several different ranges. The weight percent of the LLDPE of the barrier film may be one of the following values: about 25%, about 26%, about 27%, about 28%, about 29%, about 30%, about 31%, about 32%, about 33%, about 34%, about 35%, about 36%, about 37%, about 38%, about 39%, about 40%, about 41%, about 42%, about 43%, about 44%, and about 45%. It is within the present disclosure for the LLDPE weight percent of the barrier film to fall within one of the following ranges: less than about 45%, about 25% to about 45%, about 25% to about 40%, about 25% to about 30%, about 30% to about 45%, and about 35% to about 45%. In one example, the LLDPE comprises a polymer processing additive. In another example, the LLDPE comprises an antioxidant additive. In another example, the LLDPE comprises a polymer processing additive and an antioxidant additive.

In one example, the linear low density polypropylene (LLDPE) comprises a weight percent of about 40% of a barrier layer of the barrier film. In another example, the LLDPE comprises a weight percent of about 81% of a barrier layer of the barrier film. In another example, the LLDPE comprises a weight percent of about 85% of a barrier layer of the barrier film. In another example, the LLDPE comprises a weight percent of about 96% of a barrier layer of the barrier film. The LLDPE weight percent of a barrier layer of the barrier film may be one of several different percentages or fall within one of several different ranges. It is within the present disclosure for the LLDPE weight percent of a barrier layer of the barrier film to fall within one of the following ranges: about 25% to about 50%, about 25% to about 45%, about 25% to about 40%, about 25% to about 30%, about 30% to about 50%, about 30% to about 45%, about 35% to about 45%, about 35% to about 45%, about 75% to about 100%, about 80% to about 100%, about 85% to about 100%, about 90% to about 100%, about 95% to about 100%, about 75% to about 98%, about 80% to about 98%, about 85% to about 98%, about 90% to about 98%, and about 95% to about 98%.

In one example, the high density polypropylene (HDPE) comprises a weight percent of about 35% of the barrier film. The HDPE weight percent of the barrier film may be one of several different percentages or fall within one of several different ranges. The weight percent of the HDPE of the barrier film may be one of the following values: about 25%, about 26%, about 27%, about 28%, about 29%, about 30%, about 31%, about 32%, about 33%, about 34%, about 35%, about 36%, about 37%, about 38%, about 39%, and about 40%. It is within the present disclosure for the HDPE weight percent of the barrier film to fall within one of the following ranges: less than about 40%, about 25% to about 40%, about 25% to about 30%, about 30% to about 40%, about 30% to about 35%, and about 35% to about 40%. In one example, the HDPE comprises a polymer processing additive. In another example, the HDPE comprises an antioxidant additive. In another example, the HDPE comprises a polymer processing additive and an antioxidant additive.

In one example, the high density polypropylene (HDPE) comprises a weight percent of about 35% of a barrier layer of the barrier film. In another example, the HDPE comprises a weight percent of about 30% of a barrier layer of the barrier film. In another example, the HDPE comprises a weight percent of about 81% of a barrier layer of the barrier film. In another example, the HDPE comprises a weight percent of about 85% of a barrier layer of the barrier film. In another example, the HDPE comprises a weight percent of about 96% of a barrier layer of the barrier film. The HDPE weight percent of a barrier layer of the barrier film may be one of several different percentages or fall within one of several different ranges. It is within the present disclosure for the HDPE weight percent of a barrier layer of the barrier film to fall within one of the following ranges: about 25% to about 50%, about 25% to about 45%, about 25% to about 40%, about 25% to about 30%, about 30% to about 50%, about 30% to about 45%, about 35% to about 45%, about 35% to about 45%, about 75% to about 100%, about 80% to about 100%, about 85% to about 100%, about 90% to about 100%, about 95% to about 100%, about 75% to about 98%, about 80% to about 98%, about 85% to about 98%, about 90% to about 98%, and about 95% to about 98%.

In one example, the low density polyethylene (LDPE) comprises a weight percent of about 20% of the barrier film.

The LDPE weight percent of the barrier film may be one of several different percentages or fall within one of several different ranges. The weight percent of the LDPE of the barrier film may be one of the following values: about 15%, about 16%, about 17%, about 18%, about 19%, about 20%, about 21%, about 22%, about 23%, about 24%, about 25%, about 26%, about 27%, about 28%, about 29%, about 30%, about 31%, about 32%, about 33%, about 34%, and about 35%. It is within the present disclosure for the LDPE weight percent of the barrier film to fall within one of the following ranges: less than about 35%, about 15% to about 35%, about 20% to about 35%, about 15% to about 30%, about 20% to about 30%, and about 20% to about 25%.

In one example, the low density polypropylene (LDPE) comprises a weight percent of about 20% of a barrier layer of the barrier film. In another example, the LDPE comprises a weight percent of about 30% of a barrier layer of the barrier film. In another example, the LDPE comprises a weight percent of about 81% of a barrier layer of the barrier film. In another example, the LDPE comprises a weight percent of about 85% of a barrier layer of the barrier film. In another example, the LDPE comprises a weight percent of about 96% of a barrier layer of the barrier film. The LDPE weight percent of a barrier layer of the barrier film may be one of several different percentages or fall within one of several different ranges. It is within the present disclosure for the LDPE weight percent of a barrier layer of the barrier film to fall within one of the following ranges: about 15% to about 50%, about 15% to about 40%, about 20% to about 50%, about 20% to about 40%, about 25% to about 50%, about 25% to about 45%, about 25% to about 40%, about 25% to about 30%, about 30% to about 50%, about 30% to about 45%, about 35% to about 45%, about 35% to about 45%, about 75% to about 100%, about 80% to about 100%, about 85% to about 100%, about 90% to about 100%, about 95% to about 100%, about 75% to about 98%, about 80% to about 98%, about 85% to about 98%, about 90% to about 98%, and about 95% to about 98%.

In one example, the barrier additive comprises a weight percent of about 4% of the barrier film. In another example, the barrier additive comprises a weight percent of about 15% of the barrier film. In another example, the barrier additive comprises a weight percent of about 19% of the barrier film. The barrier additive weight percent of the barrier film may be one of several different percentages or fall within one of several different ranges. The weight percent of the barrier additive of the barrier film may be one of the following values: about 1%, about 2%, about 3%, about 4%, about 5%, about 6%, about 7%, about 8%, about 9%, about 10%, about 11%, about 12%, about 13%, about 14%, about 15%, about 16%, about 17%, about 18%, about 19%, about 20%, about 21%, and about 22%. It is within the present disclosure for the barrier additive weight percent of the barrier film to fall within one of the following ranges: less than about 22%, less than about 20%, less than about 15%, less than about 12%, less than about 10%, about 1% to about 22%, about 2% to about 22%, about 4% to about 22%, about 1% to about 20%, about 2% to about 20%, about 4% to about 20%, about 1% to about 15%, about 2% to about 15%, about 4% to about 15%, about 1% to about 5%, about 2% to about 5%, and about 3% to about 5%.

In one example, the nucleating additive comprises a weight percent of about 4% of the barrier film. The nucleating additive weight percent of the barrier film may be one of several different percentages or fall within one of several different ranges. The weight percent of the nucleating additive of the barrier film may be one of the following values: about 1%, about 2%, about 3%, about 4%, about 5%, about 6%, about 7%, about 8%, about 9%, and about 10%. It is within the present disclosure for the nucleating additive weight percent of the barrier film to fall within one of the following ranges: less than about 10%, about 1% to about 10%, about 2% to about 10%, about 1% to about 6%, about 2% to about 6%, about 1% to about 5%, about 2% to about 5%, and about 3% to about 5%.

In one example, the nucleating additive comprises a weight percent of about 4% of a barrier layer of the barrier film. The nucleating additive weight percent of a barrier layer of the barrier film may be one of several different percentages or fall within one of several different ranges. The weight percent of the nucleating additive of a barrier layer of the barrier film may be one of the following values: about 1%, about 2%, about 3%, about 4%, about 5%, about 6%, about 7%, about 8%, about 9%, and about 10%. It is within the present disclosure for the nucleating additive weight percent of the barrier film to fall within one of the following ranges: less than about 10%, about 1% to about 10%, about 2% to about 10%, about 1% to about 6%, about 2% to about 6%, about 1% to about 5%, about 2% to about 5%, and about 3% to about 5%.

In one example, the functional additive comprises a weight percent of about 15% of the barrier film. The functional additive weight percent of the barrier film may be one of several different percentages or fall within one of several different ranges. The weight percent of the functional additive of the barrier film may be one of the following values: about 10%, about 11%, about 12%, about 13%, about 14%, about 15%, about 16%, about 17%, about 18%, about 19%, about 20%, about 21%, and about 22%. It is within the present disclosure for the functional additive weight percent of the barrier film to fall within one of the following ranges: less than about 25%, less than about 22%, less than about 20%, less than about 10%, about 10% to about 25%, about 10% to about 22%, about 10% to about 20%, about 10% to about 15%, about 15% to about 25%, about 15% to about 22%, and about 15% to about 20%.

In one example, the functional additive comprises a weight percent of about 15% of a barrier layer of the barrier film. The functional additive weight percent of a barrier layer of the barrier film may be one of several different percentages or fall within one of several different ranges. The weight percent of the functional additive of a barrier layer of the barrier film may be one of the following values: about 10%, about 11%, about 12%, about 13%, about 14%, about 15%, about 16%, about 17%, about 18%, about 19%, about 20%, about 21%, and about 22%. It is within the present disclosure for the functional additive weight percent of the barrier film to fall within one of the following ranges: less than about 25%, less than about 22%, less than about 20%, less than about 10%, about 10% to about 25%, about 10% to about 22%, about 10% to about 20%, about 10% to about 15%, about 15% to about 25%, about 15% to about 22%, and about 15% to about 20%.

In one example, the colorant additive comprises a weight percent of about 1% of the barrier film. In another example, the colorant additive comprises a weight percent of about 4% of the barrier film. The colorant additive weight percent of the barrier film may be one of several different percentages or fall within one of several different ranges. The weight percent of the colorant additive of the barrier film may be one of the following values: about 0%, about 0.2%, about 0.4%, about 0.6%, about 0.8%, about 1%, about 1.2%, about 1.4%, about 1.6%, about 1.8%, about 2%, about 3%, about 4%, and about 5%. It is within the present disclosure for the colorant additive weight percent of the barrier film to fall within one of the following ranges: less than about 5%, less than about 3%, about 0% to about 5%, about 0.2% to about 5%, about 0.4% to about 5%, about 0.6% to about 5%, about 0.8% to about 5%, about 1% to about 5%, about 0% to about 3%, about 0.2% to about 3%, about 0.4% to about 3%, about 0.6% to about 3%, about 0.8% to about 3%, about 1% to about 3%, about 0% to about 2%, about 0.2% to about 2%, about 0.4% to about 2%, about 0.6% to about 2%, about 0.8% to about 2%, about 1% to about 2%, about 0.2% to about 1.8%, about 0.4% to about 1.6%, about 0.6% to about 1.4%, and about 0.8% to about 1.2%.

In one example, barrier film is about 400 μm to about 500 μm thick. In one example, barrier film is about 400 to about 600 μm thick. The barrier film may be a particular thickness or fall within one of several different ranges. The thickness of the barrier film may be one of the following values: about 25 μm, about 50 μm, about 100 μm, about 150 μm, about 200 μm, about 250 μm, about 300 μm, about 350 μm, about 360 μm, about 380 μm, about 400 μm, about 450 μm, about 500 μm, about 600 μm, about 750 μm, about 800 μm, about 850 μm, and about 900 μm. In a set of ranges, the thickness of barrier film is one of the following ranges: less than about 1000 μm, less than about 900 μm, less than about 800 μm, about 25 μm to about 1000 μm, about 25 μm to about 900 μm, about 25 μm to about 800 μm, about 100 μm to about 1000 μm, about 100 μm to about 900 μm, about 100 μm to about 800 μm, about 200 μm to about 1000 μm, about 200 μm to about 900 μm, about 200 μm to about 800 μm, about 300 μm to about 1000 μm, about 300 μm to about 900 μm, about 300 μm to about 850 μm, about 300 μm to about 800 μm, about 360 μm to about 850 μm, about 360 μm to about 800 μm, about 360 μm to about 700 μm, about 360 μm to about 600 μm, about 360 μm to about 500 μm, and about 400 μm to about 500 μm.

The barrier films in accordance with the present disclosure may have various characteristics including, but not limited to, an average weight percentage, an average thickness, a gas transmission rate, a density, a tear strength, a puncture resistance, an opacity, and any characteristic as described herein. Any layer of the barrier film may comprise a suitable polymer composition that will provide any number of suitable film characteristics of a film.

A potential feature of a film, according to exemplary embodiments of the present disclosure is that the film possesses good barrier performance as measured by water vapor transmission rate (WVTR) and oxygen transmission rate (OTR). Moisture vapor transmission rate (MVTR), interchangeably used with water vapor transmission rate (WVTR), is a measure of the passage of water vapor through a substance. MVTR may be as measured by ASTM F1249. It is a measure of the permeability for vapor barriers. Oxygen transmission rate (OTR) is the measurement of the amount of oxygen gas that passes through a substance over a given period. OTR may be as measured by ASTM D3985 or ASTM F2714-08.

In one example, the barrier film of the present disclosure may comprise advantageous barrier properties. The MVTR of the barrier film may be one of several different values or fall within one of several different ranges. The MVTR of the barrier film may be one of the following values: about 0.15 $g/m^2 \cdot day$, about 0.20 $g/m^2 \cdot day$, about 0.25 $g/m^2 \cdot day$, about 0.30 $g/m^2 \cdot day$, about 0.35 $g/m^2 \cdot day$, and about 0.40 $g/m^2 \cdot day$. It is within the present disclosure for the MVTR of the barrier film to fall within one of the following ranges: less than about 0.40 $g/m^2 \cdot day$, less than about 0.35 $g/m^2 \cdot day$, less than about 0.30 $g/m^2 \cdot day$, less than about 0.25 $g/m^2 \cdot day$, about 0.05 $g/m^2 \cdot day$ to about 0.40 $g/m^2 \cdot day$, about 0.05 $g/m^2 \cdot day$ to about 0.35 $g/m^2 \cdot day$, about 0.05 $g/m^2 \cdot day$ to about 0.30 $g/m^2 \cdot day$, about 0.05 $g/m^2 \cdot day$ to about 0.25 $g/m^2 \cdot day$, and about 0.05 $g/m^2 \cdot day$ to about 0.20 $g/m^2 \cdot day$.

In some embodiments, the barrier film may have a thickness of less than about 1000 μm and the MVTR of the barrier film may be one of several different values or fall within one of several different ranges. The barrier film may have a thickness of less than about 1000 μm and the MVTR of the barrier film may be one of the following values: about 0.15 $g/m^2 \cdot day$, about 0.20 $g/m^2 \cdot day$, about 0.25 $g/m^2 \cdot day$, about 0.30 $g/m^2 \cdot day$, about 0.35 $g/m^2 \cdot day$, and about 0.40 $g/m^2 \cdot day$. It is within the present disclosure for the barrier film to have a thickness of less than about 1000 μm and MVTR of the barrier film to fall within one of the following ranges: less than about 0.40 $g/m^2 \cdot day$, less than about 0.35 $g/m^2 \cdot day$, less than about 0.30 $g/m^2 \cdot day$, less than about 0.25 $g/m^2 \cdot day$, about 0.05 $g/m^2 \cdot day$ to about 0.40 $g/m^2 \cdot day$, about 0.05 $g/m^2 \cdot day$ to about 0.35 $g/m^2 \cdot day$, about 0.05 $g/m^2 \cdot day$ to about 0.30 $g/m^2 \cdot day$, about 0.05 $g/m^2 \cdot day$ to about 0.25 $g/m^2 \cdot day$, and about 0.05 $g/m^2 \cdot day$ to about 0.20 $g/m^2 \cdot day$.

In some embodiments, the barrier film may have a thickness of less than about 800 μm and the MVTR of the barrier film may be one of several different values or fall within one of several different ranges. The barrier film may have a thickness of less than about 800 μm and the MVTR of the barrier film may be one of the following values: about 0.15 $g/m^2 \cdot day$, about 0.20 $g/m^2 \cdot day$, about 0.25 $g/m^2 \cdot day$, about 0.30 $g/m^2 \cdot day$, about 0.35 $g/m^2 \cdot day$, and about 0.40 $g/m^2 \cdot day$. It is within the present disclosure for the barrier film to have a thickness of less than about 800 μm and MVTR of the barrier film to fall within one of the following ranges: less than about 0.40 $g/m^2 \cdot day$, less than about 0.35 $g/m^2 \cdot day$, less than about 0.30 $g/m^2 \cdot day$, less than about 0.25 $g/m^2 \cdot day$, about 0.05 $g/m^2 \cdot day$ to about 0.40 $g/m^2 \cdot day$, about 0.05 $g/m^2 \cdot day$ to about 0.35 $g/m^2 \cdot day$, about 0.05 $g/m^2 \cdot day$ to about 0.30 $g/m^2 \cdot day$, about 0.05 $g/m^2 \cdot day$ to about 0.25 $g/m^2 \cdot day$, and about 0.05 $g/m^2 \cdot day$ to about 0.20 $g/m^2 \cdot day$.

In one example, the OTR of the barrier film may be one of several different values or fall within one of several different ranges. The OTR of the barrier film may be one of the following values: about 50 $cc/m^2 \cdot day$, about 45 $cc/m^2 \cdot day$, about 40 $cc/m^2 \cdot day$, about 35 $cc/m^2 \cdot day$, about 30 $cc/m^2 \cdot day$, about 25 $cc/m^2 \cdot day$, about 20 $cc/m^2 \cdot day$, about 15 $cc/m^2 \cdot day$, and about 10 $cc/m^2 \cdot day$. It is within the present disclosure for the OTR of the barrier film to fall within one of the following ranges: less than about 50 $cc/m^2 \cdot day$, less than about 45 $cc/m^2 \cdot day$, less than about 40 $cc/m^2 \cdot day$, less than about 35 $cc/m^2 \cdot day$, less than about 30 $cc/m^2 \cdot day$, less than about 25 $cc/m^2 \cdot day$, about 5 $cc/m^2 \cdot day$ to about 50 $cc/m^2 \cdot day$, about 5 $cc/m^2 \cdot day$ to about 45 $cc/m^2 \cdot day$, about 5 $cc/m^2 \cdot day$ to about 40 $cc/m^2 \cdot day$, about 5 $cc/m^2 \cdot day$ to about 35 $cc/m^2 \cdot day$, about 5 $cc/m^2 \cdot day$ to about 30 $cc/m^2 \cdot day$, and about 5 $cc/m^2 \cdot day$ to about 25 $cc/m^2 \cdot day$.

In some embodiments, the barrier film may have a thickness of less than about 1000 μm and the OTR of the barrier film may be one of several different values or fall within one of several different ranges. The barrier film may have a thickness of less than about 1000 μm and the OTR of the barrier film may be one of the following values: about 50 $cc/m^2 \cdot day$, about 45 $cc/m^2 \cdot day$, about 40 $cc/m^2 \cdot day$, about 35 $cc/m^2 \cdot day$, about 30 $cc/m^2 \cdot day$, about 25 $cc/m^2 \cdot day$, about 20 $cc/m^2 \cdot day$, about 15 $cc/m^2 \cdot day$, and about 10 $cc/m^2 \cdot day$. It is within the present disclosure for the barrier film to have a thickness of less than about 1000 μm and OTR of the barrier film to fall within one of the following ranges: less than about 50 $cc/m^2 \cdot day$, less than about 45 $cc/m^2 \cdot day$, less than about 40 cc/m$^2$·day, less than about 35 cc/m$^2$·day, less than about 30 cc/m$^2$·day, less than about 25 cc/m$^2$·day, about 5 cc/m$^2$·day to about 50 cc/m$^2$·day, about 5 cc/m$^2$·day to about 45 cc/m$^2$·day, about 5 cc/m$^2$·day to about 40 cc/m$^2$·day, about 5 cc/m$^2$·day to about 35 cc/m$^2$·day, about 5 cc/m$^2$·day to about 30 cc/m$^2$·day, and about 5 cc/m$^2$·day to about 25 cc/m$^2$·day.

In some embodiments, the barrier film may have a thickness of less than about 800 μm and the OTR of the barrier film may be one of several different values or fall within one of several different ranges. The barrier film may have a thickness of less than about 800 μm and the OTR of the barrier film may be one of the following values: about 50 cc/m$^2$·day, about 45 cc/m$^2$·day, about 40 cc/m$^2$·day, about 35 cc/m$^2$·day, about 30 cc/m$^2$·day, about 25 cc/m$^2$·day, about 20 cc/m$^2$·day, about 15 cc/m$^2$·day, and about 10 cc/m$^2$·day. It is within the present disclosure for the barrier film to have a thickness of less than about 800 μm and OTR of the barrier film to fall within one of the following ranges: less than about 50 cc/m$^2$·day, less than about 45 cc/m$^2$·day, less than about 40 cc/m$^2$·day, less than about 35 cc/m$^2$·day, less than about 30 cc/m$^2$·day, less than about 25 cc/m$^2$·day, about 5 cc/m$^2$·day to about 50 cc/m$^2$·day, about 5 cc/m$^2$·day to about 45 cc/m$^2$·day, about 5 cc/m$^2$·day to about 40 cc/m$^2$·day, about 5 cc/m$^2$·day to about 35 cc/m$^2$·day, about 5 cc/m$^2$·day to about 30 cc/m$^2$·day, and about 5 cc/m$^2$·day to about 25 cc/m$^2$·day.

A potential feature of a film, according to exemplary embodiments of the present disclosure is that the film possesses good barrier performance as measured by methane transmission rate. Methane transmission rate may be as measured by BS ISO 15105-2. The methane transmission rate of the barrier film may be one of several different values or fall within one of several different ranges. The methane transmission rate of the barrier film may be one of the following values: about 35 mL/m$^2$·day, about 30 mL/m$^2$·day, about 25 mL/m$^2$·day, about 20 mL/m$^2$·day, about 15 mL/m$^2$·day, and about 10 mL/m$^2$·day. It is within the present disclosure for the methane transmission rate of the barrier film to fall within one of the following ranges: less than about 40 mL/m$^2$·day, less than about 35 mL/m$^2$·day, less than about 30 mL/m$^2$·day, less than about 25 mL/m$^2$·day, about 5 mL/m$^2$·day to about 40 mL/m$^2$·day, about 5 mL/m$^2$·day to about 35 mL/m$^2$·day, about 5 mL/m$^2$·day to about 30 mL/m$^2$·day, about 5 mL/m$^2$·day to about 25 mL/m$^2$·day, and about 5 mL/m$^2$·day to about 20 mL/m$^2$·day.

In some embodiments, the barrier film may have a thickness of less than about 1000 μm and the methane transmission rate of the barrier film may be one of several different values or fall within one of several different ranges. The barrier film may have a thickness of less than about 1000 μm and the methane transmission rate of the barrier film may be one of the following values: about 35 mL/m$^2$·day, about 30 mL/m$^2$·day, about 25 mL/m$^2$·day, about 20 mL/m$^2$·day, about 15 mL/m$^2$·day, and about 10 mL/m$^2$·day. It is within the present disclosure for the barrier film to have a thickness of less than about 1000 μm and methane transmission rate of the barrier film to fall within one of the following ranges: less than about 40 mL/m$^2$·day, less than about 35 mL/m$^2$·day, less than about 30 mL/m$^2$·day, less than about 25 mL/m$^2$·day, about 5 mL/m$^2$·day to about 40 mL/m$^2$·day, about 5 mL/m$^2$·day to about 35 mL/m$^2$·day, about 5 mL/m$^2$·day to about 30 mL/m$^2$·day, about 5 mL/m$^2$·day to about 25 mL/m$^2$·day, and about 5 mL/m$^2$·day to about 20 mL/m$^2$·day.

In some embodiments, the barrier film may have a thickness of less than about 800 μm and the methane transmission rate of the barrier film may be one of several different values or fall within one of several different ranges. The barrier film may have a thickness of less than about 800 μm and the methane transmission rate of the barrier film may be one of the following values: about 35 mL/m$^2$·day, about 30 mL/m$^2$·day, about 25 mL/m$^2$·day, about 20 mL/m$^2$·day, about 15 mL/m$^2$·day, and about 10 mL/m$^2$·day. It is within the present disclosure for the barrier film to have a thickness of less than about 800 μm and methane transmission rate of the barrier film to fall within one of the following ranges: less than about 40 mL/m$^2$·day, less than about 35 mL/m$^2$·day, less than about 30 mL/m$^2$·day, less than about 25 mL/m$^2$·day, about 5 mL/m$^2$·day to about 40 mL/m$^2$·day, about 5 mL/m$^2$·day to about 35 mL/m$^2$·day, about 5 mL/m$^2$·day to about 30 mL/m$^2$·day, about 5 mL/m$^2$·day to about 25 mL/m$^2$·day, and about 5 mL/m$^2$·day to about 20 mL/m$^2$·day.

Another potential feature of the barrier film according to exemplary embodiments of the present disclosure is that the barrier film can maintain barrier properties, such as vapor permeation, while down-gauging from comparative films and/or reducing or removing certain higher cost barrier materials. Barrier films, which are down-gauged may provide a reduced weight of the films and a reduction in materials, thereby lowering the cost of the films.

Another potential feature of the barrier film according to exemplary embodiments of the present disclosure is that the barrier film can be recycled. Recyclable means that a material can be added (such as regrind) back into an extrusion or other formation process without segregation of components of the material. Recyclability of the film of the present disclosure minimizes the amount of disposable waste created. In comparison, films comprising EVOH, polypropylene, polyamide, polystyrene, or polyester ordinarily cannot be reused easily in a manufacturing process with the same material from which the film was formed.

A barrier film, according to exemplary embodiments of the present disclosure satisfies a long-felt need for a film that includes many if not all the features of improved barrier performance, down-gauging, and ready for recyclability. Others have failed to provide a barrier film that achieves combinations of these features as reflected in the appended claims. This failure is a result of the many features being associated with competitive design choices. As an example, others have created films that based on design choices possess barrier performance but fail to provide comparable thicknesses. In comparison, barrier film of the present disclosure overcomes the failures of others by using a barrier additive to improve barrier performance.

To provide a more concise description, some of the quantitative expressions given herein are not qualified with the term "about." It is understood that, whether the term "about" is used explicitly or not, every quantity given herein is meant to refer to the actual given value, and it is also meant to refer to the approximation to such given value that would reasonably be inferred based on the ordinary skill in the art, including equivalents and approximations due to the experimental and/or measurement conditions for such given value.

EXAMPLES

The following examples and representative procedures illustrate features in accordance with the present disclosure, and are provided solely by way of illustration. They are not intended to limit the scope of the appended claims or their equivalents. Parts and percentages appearing in such examples are by weight, or thickness, unless otherwise stipulated. All ASTM, ISO, and other standard test methods cited or referred to in this disclosure are incorporated by reference in their entirety.

Example 1: Monolayer Film Formulations

Exemplary monolayer films in accordance with certain aspects of the present disclosure is provided in the instant example. The polymer blend formulations of Table 1 provided a monolayer film by a single layer extrusion. Ultraguard and UG refer to ULTRAGUARD™ resin available from Milliken & Co. Exemplary 400 μm, 500 μm, and 800 μm films were provided by the formulations.

TABLE 1

Formulations of Monolayer Films.

| Item | Name | 400 μm and 500 μm Yellow Benchmark wt. % | 400 μm and 500 μm Yellow with UG wt. % |
|---|---|---|---|
| Color Additive | Yellow MB (ML73480) | 1 | 1 |
| Nucleating Additive | Ultraguard | 0 | 4 |
| LLDPE | Borstar FB2230 | 40 | 40 |
| LDPE | Sabic LDPE 2100N0W | 35 | 35 |
| HDPE | Total Lumicene M6012EP | 24 | 20 |

| Item | Name | 800 μm Red wt. % | 800 μm Blue with UG wt. % |
|---|---|---|---|
| Color Additive | Red MB or Blue MB | 4 | 4 |
| Nucleating Additive | Ultraguard | 0 | 4 |
| Filler | Talc MB | 10 | 10 |
| LLDPE | Natural LLPDE Recycled | 49 | 45 |
| LDPE | Natural LPDE Recycled | 37 | 37 |

Example 2: Methane Transmission Rate Tests

Exemplary monolayer films having formulations from Table 1 in accordance with certain aspects of the present disclosure comprising 4% nucleating additive were subjected to methane transmission rate testing according to BS ISO 15105-2 in the instant example. Results are shown in Table 2.

TABLE 2

Methane Transmission Rate Analysis.

| Film Thickness (μm) | Extrusion Process | Average Gas Transmission Rate (mL/(m$^2$ · day) |
|---|---|---|
| 400 | Blown | 22.2 |
| 500 | Blown | 16.8 |
| 850 | Cast | 19.5 |
| 360 | Blown | 23.3 |
| 450 | Blown | — |
| 400 | Blown | 35.7 |
| 500 | Blown | — |
| 400 | Blown | 15.9 |
| 400 | Blown | 11.3 |

Example 3: Moisture Vapor Transmission Rate (MVTR) Tests

MVTR (F1249, 38° C., 90% Relative Humidity (RH))

Exemplary monolayer films, in accordance with certain aspects of the present disclosure comprising 4% nucleating additive were subjected to moisture transmission rate testing according to ASTM F1249 and compared to monolayer films without 4% nucleating additive in the instant example. Results are shown in Table 3 comparing films with 4% nucleating additive to comparative films without 4% nucleating additive.

Comparative films, such as DPC Zedex black 600 μm and HC Blok 400 μm (VaporBlock Plus® VBP20) available from Viaflex (formerly Raven Engineered Films), do not comprise 4% nucleating additive. HC Blok 400 is a multilayer film comprising polyethylene, polyamide, and EVOH. UG refers to ULTRAGUARD™ resin available from Milliken & Co.

TABLE 3

Moisture Vapor Transmission Rate (MVTR) Analysis.

| Film | Film Thickness (μm) | MVTR g/(m$^2$ · day) | nMVTR g · μm/ (m$^2$ · day) | MVTR Reduction (%) |
|---|---|---|---|---|
| 800 μm Red | 924 | 0.38 | 351 | |
| 800 μm Blue with UG | 869 | 0.27 | 234 | 35 |
| 500 μm Yellow Benchmark | 508 | 0.19 | 97 | |
| 500 μm Yellow with UG | 489 | 0.17 | 83 | 14 |
| 400 μm Yellow Benchmark | 404 | 0.39 | 158 | |
| 400 μm Yellow with UG | 423 | 0.25 | 106 | 33 |
| HC Blok 400 μm | 441 | 0.51 | 225 | |
| DPC Zedex Black 600 μm | 878 | 0.56 | 492 | |

Example 4: Oxygen Transmission Rate (OTR) Tests

Exemplary monolayer films in accordance with certain aspects of the present disclosure were subjected to oxygen transmission rate testing according to ASTM D3985 at 0% relative humidity (RH) and ASTM F2714-08 at 50% RH in the instant example. Results are shown in Table 4 comparing monolayer films with 4% nucleating additive to comparative films without 4% nucleating additive. OTR Reduction was determined for films with nucleating additive relative to comparative film without nucleating additive. For example, the results of ASTM F2714-08 showed 800 μm Blue with UG provided a 47% reduction in OTR compared to 800 μm Red; 500 μm Yellow with UG provided a 20% reduction in OTR compared to 500 μm Yellow Benchmark; and, 400 μm Yellow Benchmark provided a 42% reduction in OTR compared to 400 μm Yellow Benchmark. UG and NA refer to ULTRAGUARD™ resin available from Milliken & Co.

Comparative film Zedex CPT 800 μm comprises LLDPE (58% black LLDPE recycled), LDPE (35% black LDPE recycled), reinforcement filler (5% Vistamaxx 6102FL), and color (2% black color MB).

Comparative film GR1 4% NA 800 μm comprises LLDPE (54% black LLDPE recycled), LDPE (20% black LDPE recycled), HDPE (20% Total Lumicene 6012 EP), nucleating additive (4% Ultraguard MB), and color (2% black color MB).

Comparative film LPGM 500 μm comprises LLDPE (30% Exxon LL1001AV linear), LDPE (59% Natural LDPE recycled), reinforcement filler (10% talc MB), and color (1% yellow color MB).

TABLE 4

Oxygen Transmission Rate (OTR) Analysis.

| Film | ASTM D3985 at 0% RH | | ASTM F2714-08 at 50% RH | |
|---|---|---|---|---|
| | OTR cc/(m$^2$ · day) | OTR Reduction (%) | OTR cc/(m$^2$ · day) | OTR Reduction (%) |
| 800 μm Red | | | 59 | — |
| 800 μm Blue with UG | | | 31 | 47 |
| 500 μm Yellow Benchmark | 179.5 | — | 20 | — |
| 500 μm Yellow with UG | 104 | 42 | 16 | 20 |
| 400 μm Yellow Benchmark | | | 34 | — |
| 400 μm Yellow with UG | | | 20 | 42 |
| HC Blok 400 μm | | | 1 | |
| DPC Zedex Black 600 μm | | | 70 | |
| Zedex CPT 800 μm | 217.5 | — | | |
| GR1 4% NA 800 μm | 121 | 44 | | |
| LPGM 500 μm | 274 | | | |

Example 5: Transmission Electron Microscopy

Exemplary monolayer films in accordance with certain aspects of the present disclosure comprising 20% and 10% nano-barrier particles were subjected to transmission electron microscopy (TEM). A TEM image of a barrier film in accordance with the present disclosure, including 20 wt % of a barrier additive is shown in FIG. 4 and a TEM image of a barrier film in accordance with the present disclosure, including 10 wt % of a barrier additive is shown in FIG. 5.

Example 6: Co-Extruded Monolayer Film Formulations

Exemplary films in accordance with certain aspects of the present disclosure are provided in the instant example. Polymer blend formulations of Table 5 provided monolayer films by a five-layer extrusion in either a cast film or blown film extrusion process. Each extruder processed the same formulation, simulating a monolayer film by a co-extrusion process.

TABLE 5

Formulations of Co-Extruded Monolayer Films.

| Material | Layer 1 wt. % | Layer 2 wt. % | Layer 3 wt. % | Layer 4 wt. % | Layer 5 wt. % |
|---|---|---|---|---|---|
| Film A1: Mono Control (Cast) | | | | | |
| Sabic 2100N0W | 30 | 30 | 30 | 30 | 30 |
| Borstar FB2230 | 40 | 40 | 40 | 40 | 40 |
| Lumicene M6012EP | 30 | 30 | 30 | 30 | 30 |
| Layer Ratio | 20% | 20% | 20% | 20% | 20% |
| Layer thickness (μm) | 80 | 80 | 80 | 80 | 80 |
| Layer Density (g/cm$^3$) | 0.937 | 0.937 | 0.937 | 0.937 | 0.937 |
| Film A2: Mono Control (Blown) | | | | | |
| Sabic 2100N0W | 30 | 30 | 30 | 30 | 30 |
| Borstar FB2230 | 40 | 40 | 40 | 40 | 40 |
| Lumicene M6012EP | 30 | 30 | 30 | 30 | 30 |
| Layer Ratio | 15% | 15% | 40% | 15% | 15% |
| Layer thickness (μm) | 30 | 30 | 80 | 30 | 30 |
| Film B1: Mono 4% Nucleating Additive (Cast) | | | | | |
| Sabic 2100N0W | 30 | 30 | 30 | 30 | 30 |
| Borstar FB2230 | 36 | 36 | 36 | 36 | 36 |
| Lumicene M6012EP | 30 | 30 | 30 | 30 | 30 |
| Ultraguard 10309 | 4 | 4 | 4 | 4 | 4 |
| Layer Ratio | 20% | 20% | 20% | 20% | 20% |
| Layer thickness (μm) | 80 | 80 | 80 | 80 | 80 |
| Layer Density (g/cm$^3$) | 0.938 | 0.938 | 0.938 | 0.938 | 0.938 |
| Film B2: Mono 4% Nucleating Additive (Blown) | | | | | |
| Sabic 2100N0W | 30 | 30 | 30 | 30 | 30 |
| Borstar FB2230 | 36 | 36 | 36 | 36 | 36 |
| Lumicene M6012EP | 30 | 30 | 30 | 30 | 30 |
| Ultraguard 10309 | 4 | 4 | 4 | 4 | 4 |
| Layer Ratio | 15% | 15% | 40% | 15% | 15% |
| Layer thickness (μm) | 30 | 30 | 80 | 30 | 30 |
| Film C1: Mono 15% Functional Additive (Cast) | | | | | |
| Sabic 2100N0W | 30 | 30 | 30 | 30 | 30 |
| Borstar FB2230 | 25 | 25 | 25 | 25 | 25 |
| Lumicene M6012EP | 30 | 30 | 30 | 30 | 30 |
| Ampacet 1001293-E | 15 | 15 | 15 | 15 | 15 |
| Layer Ratio | 20% | 20% | 20% | 20% | 20% |
| Layer thickness (μm) | 80 | 80 | 80 | 80 | 80 |
| Layer Density (g/cm$^3$) | 0.935 | 0.935 | 0.935 | 0.935 | 0.935 |

Example 7: DSC-Analysis of Co-Extruded Monolayer Films

Exemplary monolayer films from Table 5 in accordance with certain aspects of the present disclosure were subjected to differential scanning calorimetry (DSC) analysis to determine melt temperature and crystallinity. Results are shown in Table 6.

No change in peak temperature was observed for the films. Crystallization peak area increased with 4% nucleating additive, for example, Film B2 comprising 4% nucleating additive displayed a 30% increase compared to Film A2 without nucleating additive.

TABLE 6

DSC-Analysis of Co-Extruded Mono-Layer Films

| Film | $T_C$ (°C) | $Q_C$ (J/g) |
|---|---|---|
| A1: Mono control | 117.2 | 78.7 |
| B1: Mono 4% Nucleating Additive | 117.5 | 74.3 |
| C1: Mono 15% Functional Additive | 117.3 | 59.3 |
| A2: Mono control | 117.1 | 57.4 |
| B2: Mono 4% Nucleating Additive | 117.8 | 74.9 |
| A3: Mono control | 117.7 | 89.8 |
| B3: Mono 4% Nucleating Additive | 118.1 | 102.6 |

Example 8: Multi-Layer Film Formulations

Exemplary films in accordance with certain aspects of the present disclosure are provided in the instant example. Polymer blend formulations of Table 7 provided multi-layer films by a five-layer extrusion in either a cast film or blown film extrusion process.

TABLE 7

| Formulations of Co-Extruded Multi-layer Films | | | | | |
|---|---|---|---|---|---|
| Material | Layer 1 wt. % | Layer 2 wt. % | Layer 3 wt. % | Layer 4 wt. % | Layer 5 wt. % |
| Film D1: Co-Ex Control (Cast) | | | | | |
| Sabic 2100N0W | 100 | 0 | 0 | 0 | 100 |
| Borstar FB2230 | 0 | 100 | 0 | 100 | 0 |
| Lumicene M6012EP | 0 | 0 | 100 | 0 | 0 |
| Layer Ratio | 15 | 20 | 30 | 20 | 15 |
| Layer thickness (μm) | 60 | 80 | 120 | 80 | 60 |
| Layer Density (g/cm$^3$) | 0.922 | 0.923 | 0.960 | 0.923 | 0.922 |
| Film D2: Co-Ex Control (Blown) | | | | | |
| Sabic 2100N0W | 100 | 0 | 0 | 0 | 100 |
| Borstar FB2230 | 0 | 0 | 100 | 0 | 0 |
| Lumicene M6012EP | 0 | 100 | 0 | 100 | 0 |
| Layer Ratio | 15 | 15 | 40 | 15 | 15 |
| Layer thickness (μm) | 30 | 30 | 80 | 30 | 30 |
| Film E1: Co-Ex 4% Nucleating Additive (Cast) | | | | | |
| Sabic 2100N0W | 96 | 0 | 0 | 0 | 96 |
| Borstar FB2230 | 0 | 96 | 0 | 96 | 0 |
| Lumicene M6012EP | 0 | 0 | 96 | 0 | 0 |
| Ultraguard 10309 | 4 | 4 | 4 | 4 | 4 |
| Layer Ratio | 15 | 20 | 30 | 20 | 15 |
| Layer thickness (μm) | 60 | 80 | 120 | 80 | 60 |
| Layer Density (g/cm$^3$) | 0.922 | 0.923 | 0.960 | 0.923 | 0.922 |
| Film E2: Co-Ex 4% Nucleating Additive (Blown) | | | | | |
| Sabic 2100N0W | 96 | 0 | 0 | 0 | 96 |
| Borstar FB2230 | 0 | 0 | 96 | 0 | 0 |
| Lumicene M6012EP | 0 | 96 | 0 | 96 | 0 |
| Ultraguard 10309 | 4 | 4 | 4 | 4 | 4 |
| Layer Ratio | 15 | 15 | 40 | 15 | 15 |
| Layer thickness (μm) | 30 | 30 | 80 | 30 | 30 |
| Film F1: Co-Ex 4% Nucleating Additive and 15% Functional Additive (Blown) | | | | | |
| Sabic 2100N0W | 81 | 0 | 0 | 0 | 81 |
| Borstar FB2230 | 0 | 0 | 81 | 0 | 0 |
| Lumicene M6012EP | 0 | 81 | 0 | 81 | 0 |
| Ampacet 1001293-E | 15 | 15 | 15 | 15 | 15 |
| Ultraguard 10309 | 4 | 4 | 4 | 4 | 4 |
| Layer Ratio | 15 | 15 | 40 | 15 | 15 |
| Layer thickness (μm) | 30 | 30 | 80 | 30 | 30 |
| Film G1: Co-Ex 15% Functional Additive (Blown) | | | | | |
| Sabic 2100N0W | 85 | 0 | 0 | 0 | 85 |
| Borstar FB2230 | 0 | 0 | 85 | 0 | 0 |
| Lumicene M6012EP | 0 | 85 | 0 | 85 | 0 |
| Ampacet 1001293-E | 15 | 15 | 15 | 15 | 15 |
| Layer Ratio | 15 | 15 | 40 | 15 | 15 |
| Layer thickness (μm) | 30 | 30 | 80 | 30 | 30 |

Example 9: DSC-Analysis of Co-Extruded Multi-Layer Films

Exemplary films of Table 7 in accordance with certain aspects of the present disclosure were subjected to differential scanning calorimetry (DSC) analysis to determine melt temperature and crystallinity. Results are shown in Table 8.

Approximately a 3° C. increase in temperature of LLDPE was observed with 4% nucleating additive; for example, Film E1 comprising 4% nucleating additive displayed a $T_c$ of 114.5 compared to Film D1 with a $T_c$ of 110.2. Additionally, films comprising 4% nucleating additive (Film E2), 4% nucleating additive and 15% functional additive (Film F1), and 15% functional additive (Film G1) displayed a $T_c$ of 115.0, 114.5, and 116.8, respectively, compared to film D2 with a $T_c$ of 111.8.

Approximately a 1° C. increase in temperature of HDPE was observed with films comprising 4% nucleating additive (Film E2), 4% nucleating additive and 15% functional additive (Film F1), and 15% functional additive (Film G1) compared to Film D2 with a $T_c$ of 119.3.

Crystallization peak area increased with 4% nucleating additive, for example, Film E2 (4% nucleating additive) and Film F1 (4% nucleating additive and 15% functional additive) displayed about a 23% increase compared to Film D2.

TABLE 8

| DSC-Analysis of Co-Extruded Multi-Layer Films | | | | | | |
|---|---|---|---|---|---|---|
| Film | $T_C$ – LDPE (° C.) | $T_C$ – LLDPE (° C.) | $T_C$ – HDPE (° C.) | $Q_C$ – LDPE (J/g) | $Q_C$ – LLDPE (J/g) | $Q_C$ – HDPE (J/g) |
| D1: Co-ex Control | 97.8 | 110.2 | 120.0 | 4.6 | 69.2 | |
| E1: Co-ex 4% Nucleating Additive | 97.5 | 114.5 | 120.2 | 4.7 | 70.1 | |
| D2: Co-ex Control | 97.2 | 111.8 | 119.3 | 8 | 47.7 | |
| E2: Co-ex 4% Nucleating Additive | 96.9 | 115.0 | 120.5 | 5.9 | 58.6 | |
| F1: Co-ex 15% Functional Additive and 4% Nucleating Additive | 97.9 | 114.5 | 119.9 | 5.8 | 58.8 | |
| G1: Co-ex 15% Functional Additive | 95.7 | 116.8 | 120.1 | 6.7 | 36.8 | |

Example 10: Oxygen Transmission Rate (OTR) Tests

Exemplary films of Table 5 and Table 7 in accordance with certain aspects of the present disclosure were subjected to oxygen transmission rate testing according to ASTM D3985 at 0% relative humidity (RH) and ASTM F2714-08 at 50% RH in the instant example. Results are shown in Table 9. OTR Reduction was determined for Film B2 relative to Film A2 and Films E2, F1, and G1 relative to Film D2. Film B2 comprising 4% nucleating additive displayed a 64% reduction in OTR compared to Film A2 without additive.

TABLE 9

| Oxygen Transmission Rate (OTR) Test | | | | |
|---|---|---|---|---|
| | ASTM D3985 at 0% RH | | ASTM F2714-08 at 50% RH | |
| Film | OTR cc/(m$^2$ · day) | OTR Reduction (%) | OTR cc/(m$^2$ · day) | OTR Reduction (%) |
| A2: Mono Control | 739 | — | 77 | — |
| B2: Mono 4% Nucleating Additive | 266 | 64 | 52 | 32 |
| D2: Co-ex Control | 503 | — | 99 | — |
| E2: Co-ex 4% Nucleating Additive | 267 | 47 | 40 | 60 |
| F1: Co-ex 15% Functional Additive and 4% Nucleating Additive | 227 | 55 | 38 | 62 |
| G1: Co-ex 15% Functional Additive | 281 | 44 | 44 | 56 |

Example 11: Secant Modulus

Exemplary films of Table 5 and Table 7 in accordance with certain aspects of the present disclosure were subjected to secant modulus testing according to ASTM D882. Results are shown in Table 10.

Significant increase in secant modulus for machine direction and transverse direction was observed for all tested films comprising nucleating additive. For example, film E2 displayed an increase of about 30%-50% compared to control film D2. In particular, film E2 displayed a 41% increase in MD 1% Secant Modulus (Mpa) and a 55% increase in TD 1% Secant Modulus (Mpa).

TABLE 10

| Secant Modulus Analysis | | |
|---|---|---|
| | A2: Mono control | B2: Mono 4% Nucleating Additive |
| Machine Direction | | |
| MD 1% Secant Modulus (Mpa) | 459.2 | 507.6 |
| MD 2% Secant Modulus (Mpa) | 371.8 | 395.0 |
| MD 3% Secant Modulus (Mpa) | 133.1 | 139.8 |
| Transverse Direction | | |
| TD 1% Secant Modulus (Mpa) | 588.2 | 755.0 |
| TD 2% Secant Modulus (Mpa) | 456.7 | 585.5 |
| TD 3% Secant Modulus (Mpa) | 139.3 | 160.0 |

| | D2: Co-ex Control | E2: Co-ex 4% Nucleating Additive | F1: Co-ex 15% FA and 4% NA | G1: Co-ex 15% Functional Additive |
|---|---|---|---|---|
| Machine Direction | | | | |
| MD 1% Secant Modulus (Mpa) | 367.8 | 520.1 | 473.8 | 351.6 |
| MD 2% Secant Modulus (Mpa) | 286.7 | 394.1 | 353.5 | 271.1 |
| MD 3% Secant Modulus (Mpa) | 103.3 | 133.4 | 120.8 | 98.5 |
| Transverse Direction | | | | |
| TD 1% Secant Modulus (Mpa) | 453 | 701.3 | 586.7 | 442.2 |
| TD 2% Secant Modulus (Mpa) | 348.9 | 535.3 | 438.2 | 337.4 |
| TD 3% Secant Modulus (Mpa) | 116 | 147.2 | 131.4 | 106.6 |

The invention claimed is:

1. A barrier film for a structure, the barrier film comprising a polymeric sheet adapted to lie between ground underlying a structure and a portion of the structure to minimize movement of a gas from the ground through the polymeric sheet and into the structure, wherein the polymeric sheet is formed from a barrier film comprising a formulation configured to provide a tortuous path for the gas from the ground that minimizes movement of the gas through the polymeric sheet, wherein the barrier film comprises at least one of a barrier layer, and wherein the barrier layer comprises linear low density polyethylene (LLDPE) and a barrier additive.

2. The barrier film of claim 1, wherein the gas is selected from at least one of radon, methane, carbon dioxide, oxygen, water vapor, and carbon monoxide.

3. The barrier film of claim 1, wherein the gas is selected from at least one of radon, methane, and carbon dioxide.

4. The barrier film of claim 1, wherein the linear low density polyethylene comprises a weight percent of about 40% to about 98% of the barrier film.

5. The barrier film of claim 4, wherein the linear low density polyethylene comprises a weight percent of about 75% to about 98% of the barrier film.

6. The barrier film of claim 1, wherein the barrier additive is a physical barrier additive, a nucleating additive, a functional additive, or any combination thereof.

7. The barrier film of claim 1, wherein the barrier additive is a nucleating additive.

8. The barrier film of claim 1, wherein the barrier additive is a functional additive.

9. The barrier film of claim 1, wherein the barrier additive is of from about 2 wt. % to about 20 wt. % of the barrier film.

10. The barrier film of claim 9, wherein the barrier additive is of from about 2 wt. % to about 5 wt. % of the barrier film.

11. The barrier film of claim 2, wherein the barrier film further comprises at least one of high density polyethylene (HDPE) or low density polyethylene (LDPE).

12. The barrier film of claim 11, wherein the barrier film comprises at least two of high density polyethylene, linear low density polyethylene, or low density polyethylene.

13. The barrier film of claim 1, wherein the barrier film has a thickness of from about 25 μm to about 1000 μm.

14. The barrier film of claim 13, wherein the barrier film has a thickness of from about 400 μm to about 800 μm.

15. The barrier film of claim 1, wherein the barrier film is a monolayer film.

16. The barrier film of claim 1, wherein the barrier film is a multilayer film.

17. The barrier film of claim 1, wherein the barrier film is provided by a blown film extrusion process or a cast film extrusion process.

18. A barrier film comprising a formulation, the formulation comprising linear low density polyethylene, and a barrier additive, wherein the formulation is configured to provide a tortuous path for ground gas and vapor contact through the barrier film so that ground gas and vapor permeation is minimized, wherein the barrier film comprises at least one of a barrier layer, and the barrier layer comprises the formulation.

19. A method of providing a barrier film to a structure, the method comprising positioning a polymeric sheet to lie between ground underlying the structure and a portion of the structure to minimize movement of a gas from the ground through the polymeric sheet and into the structure, wherein the polymeric sheet is formed from a barrier film comprising a formulation configured to provide a tortuous path for the gas from the ground that minimizes movement of the gas through the barrier film, wherein the barrier film comprises at least one of a barrier layer, and wherein the barrier layer comprises linear low density polyethylene and a barrier additive.

20. The barrier film of claim 1, wherein the barrier film is free of ethylene-vinyl alcohol copolymer (EVOH).

* * * * *